United States Patent [19]

Higashi et al.

[11] Patent Number: 4,862,216

[45] Date of Patent: Aug. 29, 1989

[54] MULTICOLOR COPYING APPARATUS

[75] Inventors: Toshikazu Higashi; Masazumi Ito, both of Osaka, Japan

[73] Assignee: Minolta Camera Kabushiki Kaisha, Osaka, Japan

[21] Appl. No.: 148,625

[22] Filed: Jan. 26, 1988

[30] Foreign Application Priority Data

| | | | |
|---|---|---|---|
| Jan. 28, 1987 | [JP] | Japan | 62-18847 |
| Feb. 12, 1987 | [JP] | Japan | 62-30004 |
| May 21, 1987 | [JP] | Japan | 62-124159 |

[51] Int. Cl.[4] ..... G03G 15/00; G03G 15/01

[52] U.S. Cl. ..... 355/218; 355/245; 355/328; 355/326

[58] Field of Search ..... 355/4, 7, 14 R, 3 R, 355/3 DD, 14 D, 14 C; 118/645, 653; 358/75, 78, 80

[56] References Cited

U.S. PATENT DOCUMENTS

| | | | |
|---|---|---|---|
| 2,910,963 | 11/1959 | Herman | 355/3 |
| 3,572,288 | 6/1968 | Turner | 355/14 |
| 3,914,043 | 10/1975 | McVeigh | 355/4 |
| 3,960,445 | 6/1976 | Drawe | 355/14 |
| 3,967,891 | 7/1976 | Rippstein | 355/3 R |
| 4,099,860 | 7/1978 | Connin | 355/14 |
| 4,346,982 | 8/1982 | Nakajima et al. | 355/3 R |
| 4,373,798 | 2/1983 | Tsukada et al. | 355/3 DD |
| 4,572,102 | 2/1986 | Yuge et al. | 118/689 |
| 4,579,443 | 4/1986 | Abuyama et al. | 355/4 |
| 4,619,514 | 10/1986 | Ide | 355/3 R |
| 4,627,707 | 12/1986 | Tani et al. | 355/14 R |
| 4,634,259 | 1/1987 | Oishi et al. | 355/4 |
| 4,641,602 | 2/1987 | Kasai | 118/653 |
| 4,657,376 | 4/1987 | Ide | 355/14 R |
| 4,659,211 | 4/1987 | Oka | 355/14 D |
| 4,666,288 | 5/1987 | Watanabe | 355/14 R |
| 4,668,978 | 5/1987 | Gokita | 358/78 |
| 4,674,861 | 6/1987 | Kawamura | 355/4 |
| 4,685,794 | 8/1987 | Watanabe | 355/7 |
| 4,690,543 | 9/1987 | Watanabe | 355/4 |
| 4,707,110 | 11/1987 | Harada et al. | 355/7 |
| 4,707,713 | 11/1987 | Ayata et al. | 355/7 X |
| 4,710,016 | 12/1987 | Waatanabe | 355/4 |
| 4,720,730 | 1/1988 | Ito | 355/4 |
| 4,723,148 | 2/1988 | Hamakawa | 355/14 SH |
| 4,728,985 | 3/1988 | Nakashima et al. | 355/7 |
| 4,740,811 | 4/1988 | Watanabe | 355/61 |
| 4,743,945 | 5/1988 | Ito et al. | 355/14 SH |
| 4,743,946 | 5/1988 | Nishimori et al. | 355/14 C |
| 4,745,437 | 5/1988 | Oka et al. | 355/14 CH |
| 4,746,954 | 5/1988 | Matuura et al. | 355/14 D |
| 4,754,301 | 6/1988 | Kasamura et al. | 355/3 DD |
| 4,769,675 | 9/1988 | Watanabe | 355/14 R |
| 4,772,921 | 9/1988 | Ito | 355/14 SH |

FOREIGN PATENT DOCUMENTS

| | | |
|---|---|---|
| 3705511 | 9/1987 | Fed. Rep. of Germany . |
| 48-22212 | 7/1973 | Japan . |
| 51-134635 | 11/1976 | Japan . |
| 54-30833 | 3/1979 | Japan . |
| 60-170868 | 9/1985 | Japan . |
| 60-212778 | 10/1985 | Japan . |
| 61-203474 | 1/1986 | Japan . |
| 61-72270 | 4/1986 | Japan . |

*Primary Examiner*—A. C. Prescott

*Attorney, Agent, or Firm*—Burns, Doane, Swecker & Mathis

[57] ABSTRACT

A copying apparatus in which after a single scan multicolor copy mode and a region to be copied are specified to carry out the single scan multicolor copy, when the specified mode is cancelled, a developing unit which has been selected in the single scan multicolor copy mode is automatically selected again and thus, a copy operation can be continued.

30 Claims, 13 Drawing Sheets

| Toner Color | Switch(SW1) | Switch(SW2) |
|---|---|---|
| Black | ON | ON |
| Red | ON | OFF |
| Yellow | OFF | ON |
| — | OFF | OFF |

MULTICOLOR COPYING APPARATUS

BACKGROUND OF THE INVENTION

1. Field of the Invention

The present invention relates to a copying apparatus capable of carrying out a multicolor copy (hereinafter referred to as single scan multicolor copy) in one copy operation.

2. Description of the Prior Art

It is practicable that in a copying machine capable of carrying out a multicolor copy after a specified single scan multicolor copy mode is cancelled, a specific developing unit is always selected so as to carry out a next copy.

A single scan multicolor copy mode is specified in order to increase the efficiency owing to the change of colors of particular portions of a number of original documents. For example, some portions of a description of several pages are often copied in color. Headlines, charts, photographs or the like of a sheet of a manuscript are also copied in color. In continuously copying remaining original documents by selecting a specific developing unit after a single scan multicolor copy mode is cancelled, the following problem arises: If the developing unit to be used for copying the remaining documents is different from the one which has been specified in carrying out a multicolor copy, it is necessary to select the developing unit which has been used before the single scan multicolor copy is carried out, which is troublesome for an operator and much time is required in carrying out a copy operation. Therefore, the development of an improved copying machine capable of accomplishing a single scan multicolor copy has been desired.

SUMMARY OF THE INVENTION

Accordingly, an essential object of the present invention is to provide an improved copying apparatus which overcomes such a problem as described above.

In accomplishing this and other objects, a copying apparatus capable of carrying out a single scan multicolor copy according to the present invention comprises an original document placing plate, an electrostatic latent image holding member, means for forming an electrostatic latent image, a developing means, a supply means, a transfer means, a switching means, a developing unit selection means, a first mode copying operation means, a region specifying means, a drive means, a second mode copying means, a storing means and a return control means. The original document placing plate is disposed at a predetermined place of a housing of the copying apparatus. On the plate an original document is placed. The electrostatic latent image holding member supports rotatably in the housing of the copying apparatus. The means for forming an electrostatic latent image is disposed in the vicinity of said original document placing plate. The means exposes an image of the original document placed on said original document placing plate so as to form an electrostatic latent image, corresponding to the image of the original document, on said electrostatic latent image holding member. The developing means is disposed in the periphery of said electrostatic latent image holding member in the housing of the copying apparatus. The means has at least a first developing unit housing a first developer and a second developing unit housing a second developer different in the color thereof from the color of the first developer housed in the first developing unit. The supply means is disposed at a predetermined place of the housing of the copying apparatus. The means supplies a material to be copied sequentially to said electrostatic latent image holding member. The transfer means is disposed in the periphery of said electrostatic latent image holding member in the housing of the copying apparatus. The means transfers the developed image to the material to be copied supplied by said supply means. The switching means switches a copy mode from a first mode in which a monochrome copying operation is carried out by selecting any one of the developing units to a second mode in which a plural color copying operation is carried out during one image exposure operation and vice versa. The developing unit selection means selects and specifies any one of the developing units when the first mode is specified by said switching means. The first mode copying operation means carries out a monochrome copying operation when the first mode is specified by said switching means. The region specifying means specifies a region of the original document image to be developed by the first developer so as to be copied and a region of the original document image to be developed by the second developer so as to be copied. The drive means drives either the first developing unit or the second developing unit during one image exposure operation according to a region specified by said region specifying means in the housing of the copying apparatus so as to supply said electrostatic latent image holding member with the developer housed either in the first developing unit or in the second developing unit so as to develop the electrostatic latent image formed on said electrostatic latent image holding member. The second mode copying means carries out a copying operation in the second mode when the second mode is specified by said switching means. The storing means stores a developing unit which has been selected in the first mode when a copy mode is switched by said switching means from the first mode to the second mode. The return control means selects automatically a developing unit stored by said storing means when a copy mode is switched from the second mode to the first mode by said switching means.

In one preferred embodiment of the present invention, there is provided a copying apparatus which comprises an original document placing plate, an electrostatic latent image holding member, means for forming an electrostatic latent image, a developing means, a supply means, a transfer means, a switching means, a developing unit selection means, a first mode copying operation means, a region specifying means, a drive means, a second mode copying operation means, a storing means and a return control means. The original document placing plate is disposed at a predetermined place of a housing of the copying apparatus and on which an original document is placed. The electrostatic latent image holding member supports rotatably in the housing of the copying apparatus. The means for forming an electrostatic latent image is disposed in the vicinity of said original document placing plate. The means exposes an image of the original document placed on said original document placing plate so as to form an electrostatic latent image, corresponding to the image of the original document, on said electrostatic latent image holding member. The developing means is disposed in the periphery of said electrostatic latent image holding member in the housing of the copying apparatus. The means has at least a first developing unit housing a first developer and a second developing unit housing a second developer different in the color thereof from the color of the first developer housed in the first developing unit, and supplies said electrostatic latent image holding member with the developer housed either in the first developing unit or in the second developing unit so as to develop the electrostatic latent image formed on said electrostatic latent image holding member. The supply means is disposed at a predetermined place of the housing of the copying apparatus. The means supplies a material to be copied sequentially to said electrostatic latent image holding member. The transfer means is disposed in the periphery of said electrostatic latent image holding member in the housing of the copying apparatus. The means transfers the developed image to the material to be copied supplied by said supply means. The switching means switches a copy mode from a first mode in which a monochrome copying operation is carried out by selecting any one of the developing units to a second mode in which a plural color copying operation is carried out during one image exposure operation and vice versa. The developing unit selection means selects and specifying any one of the developing units when the first mode is specified by said switching means. The first mode copying operation means carries out a monochrome copying operation when the first mode is specified by said switching means. The region specifying means specifies a region of the original document image to be developed by the first developer so as to be copied and a region of the original document image to be developed by the second developer so as to be copied. The drive means develops an electrostatic latent image corresponding to a region specified by said region specifying means by the first developing unit housing the first developer during one image exposure operation and develops an electrostatic latent image corresponding to a region specified by said region specifying means by the second developing unit housing the second developer. The second mode copying operation means operates said drive control means to carry out a copying operation in the second mode when the second mode is specified by said switching means. The storing means stores a developing unit which has been selected in the first mode when a copy mode is switched by said switching means from the first mode to the second mode. The return control means selects automatically a developing unit which has been stored by said storing means when a copy mode is switched from the second mode to the first mode by said switching means.

In another preferred embodiment of the present invention, there is provided a copying apparatus which comprises an original document placing plate, an electrostatic latent image holding member, means for forming an electrostatic latent image, a developing means, a first drive means, a second drive means, a supply means, a transfer means, a switching means, a developing unit selection means, a first mode copying operation means, a region specifying means, a drive control means, a second mode copying operation means, a storing means and a return control means. The original document placing plate is disposed at a predetermined place of the housing of the copying apparatus and on the plate an original document is placed. The electrostatic latent image holding member rotatably supported in the housing of the copying apparatus. The means for forming an electrostatic latent image is disposed in the vicinity of said original document placing plate. The means exposes an image of the original document placed on said original document placing plate so as to form an electrostatic latent image, corresponding to the image of the original document, on said electrostatic latent image holding member. The developing means is disposed in the periphery of said electrostatic latent image holding member in the housing of the copying apparatus, and has at least a first developing unit having a developing sleeve housing a first developer and a second developing unit having a developing sleeve housing a second developer different in its color from the color of the first developer housed in the first developing unit, and supplies said electrostatic latent image holding member with the developer housed either in the first developing unit or in the second developing unit so as to develop the electrostatic latent image formed on said electrostatic latent image holding member. The first drive means and the second drive means drive the first developing sleeve and the second developing sleeve, respectively. The supply means is disposed at a predetermined place of the housing of the copying apparatus. The means sequentially supplies said electrostatic latent image holding member with a material to be copied. The transfer means is disposed in the periphery of said electrostatic latent image holding member in the housing of the copying apparatus. The means transfers the developed image to the material to be copied supplied by said supply means. The switching means switches a copy mode from a first mode in which a monochrome copying operation is carried out by selecting any one of the developing units to a second mode in which a plural color copying operation is carried out during one image exposure operation and vice versa. The developing unit selection means selects any one of the developing units when the first mode is specified by said switching means and allowing said first drive means to drive the first developing sleeve or said second drive means to drive the second developing sleeve. The first mode copying operation means carries out a monochrome copying operation when the first mode is specified by said switching means. The region specifying means specifies a region of the original document image to be developed by the first developer so as to be copied and a region of the original document image to be developed by the second developer so as to be copied. The drive control means develops an $ electrostatic latent image into a visible image with the first developer by allowing said first drive means to drive the first developing sleeve without driving the second developing sleeve when an electrostatic latent image corresponding to a region specified by said region specifying means is developed by the first developing unit during one image exposure operation, and for developing an electrostatic latent image into a visible image with the second developer by allowing said second drive means to drive the second developing sleeve without driving the first developing sleeve when an electrostatic latent image corresponding to a region specified by said region specifying means is developed by the second developing unit during one image exposure operation. The second mode copying operation means operates said drive control means so as to carry out a copying operation in the second mode when the second mode is specified by said switching means. The storing means stores a developing unit which has been selected in the first mode when a copy mode is switched by said switching means from the first mode to the second mode. The return control means selects automatically a developing unit which has been stored by said storing means when a copy mode is switched by said switching means from the second mode to the first mode.

In another preferred embodiment of the present invention, there is provided a copying machine which comprises an original document placing plate, an electrostatic latent image holding member, means for forming an electrostatic latent image, a developing means, a first drive means, a second drive means, a supply means, a transfer means, a switching means, a developing unit selection means, a first mode copying operation means, a region specifying means, a drive control means, a second mode copying operation means, a storing means, and a return control means. The original document placing plate is disposed at a predetermined place of a housing of the copying apparatus and on which an original document is placed. The electrostatic latent image holding member supports rotatably in the housing of the copying apparatus. The means for forming an electrostatic latent image is disposed in the vicinity of said original document placing plate. The means exposes an image of the original document placed on said original document placing plate so as to form an electrostatic latent image, corresponding to the image of the original document, on said electrostatic latent image holding member. The developing means is disposed in the periphery of said electrostatic latent image holding member in the housing of the copying apparatus, and has at least a first developing unit which houses a first developer and has a first developing sleeve provided with a plurality of N poles and S poles disposed in the circumferential direction thereof and a second developing unit which houses a second developer different in its color from the first developer and has a second developing sleeve provided with a plurality of N poles and S poles disposed in the circumferential direction thereof and supplies said electrostatic latent image holding member with a developer housed either in the first developing unit or in the second developing unit so as to develop the electrostatic latent image formed on said electrostatic latent image holding member. The first drive means and the second drive means for rotating the first developing sleeve and the second developing sleeve at a predetermined angle, respectively. The supply means is disposed at a predetermined place of the housing of the copying apparatus. The means supplies sequentially said electrostatic latent image holding member with a material to be copied. The transfer means is dispose in the periphery of said electrostatic latent image holding member in the housing of the copying apparatus. The image transfers the developed image to the material to be copied supplied by said supply means. The switching means switches a copy mode from a first mode in which a monochrome copying operation is carried out by selecting any one of the developing units to a second mode in which a plural color copying operation is carried out during one image exposure operation and vice versa. The developing unit selection means selects any one of the developing units when the first mode is specified by said switching means, whereby the first developing sleeve is driven by the said first drive means or the second developing sleeve is driven by said second drive means. The first mode copying operation means carries out a monochrome copying operation when the first mode is specified by said switching means. The region specifying means specifies a region of the original document image to be developed by the first developer so as to be copied and a region of the original document image to be developed by the second developer so as to be copied. The drive control means, when an electrostatic latent image corresponding to a region specified by said region specifying means is developed by the first developing unit housing the first developer, develops an electrostatic latent image into a visible image with the first developer by allowing said first drive means to drive the first developing sleeve during one image exposure operation and rotates said second magnetic means so as not to allow any one of the N poles and the S poles to be present in the specified developing region in order to prevent the developing operation of the second developer. And when an electrostatic latent image corresponding to a region specified by said region specifying means is developed by the second developing unit housing the second developer, the means develops an electrostatic latent image into a visible image with the second developer by allowing said second drive means to drive the second developing sleeve during one image exposure operation and rotates said first magnetic means so as not to allow any one of the N poles and the S poles to be present in the specified developing region in order to prevent the developing operation of the first developer. The second mode copying operation means operates said drive control means so as to carry out a copying operation in the second mode when the second mode is specified by said switching means. The storing means stores a developing unit which has been selected in the first mode when a copy mode is switched by said switching means from the first mode to the second mode. The return control means selects automatically a developing unit which has been stored by said storing means when a copy mode is switched by said switching means from the second mode to the first mode.

In another preferred embodiment of the present invention, there is provided a copying apparatus which comprises means for forming an image, a mode selection means, a developing unit selection means, a first display means, and a second display means. The means for forming an image has a first developing unit housing a first developer and a second developing unit housing a second developer different in color thereof from a color of the first developer housed in the first developing unit. The mode selection means selects one of a first mode in which a monochromatic image forming operation is carried out by selecting any one of the developing units and a second mode in which a multicolor image forming operation is carried out by selecting both of the developing units. The developing unit selection means selects any one of the developing units when the first mode is selected. The first display means displays a kind of the developing unit selected in the first mode. The second display means displays both kinds of the developing units when the second mode is selected.

In another preferred embodiment of the present invention, there is provided a copying apparatus which comprises means for forming an image, a color display means, a color specifying means, a mode selection means, a first display control means, and a second display control means. The means for forming an image has a plurality of developing units, each of the developing units housing a developer different in color thereof from colors of developers of the remaining developing units. The color display means displays at least one of the colors of the developers of the developing units. The color specifying means specifies at least one of the colors of the developers of the developing units. The mode selection means selects one of a first mode in which a monochromatic image forming operation is carried out by selecting any one of the developing units and a second mode in which a multicolor image forming operation is carried out. The first display control means controls said color display means so as to display the color of the developer of the developing unit specified by said color specifying means when the first mode is selected. The second display control means controls said color display means so as to display the colors of the developers housed in all of the developing units when the second mode is selected.

In another preferred embodiment of the present invention, there is provided a copying apparatus which comprises means for forming an image, a detecting means, a color display means, a mode selection means, a first display control means, and a second display control means. The means for forming an image has two developing units. Each of the developing unit houses a developer different in color thereof from colors of the remaining developing units and at least any one of the developing units is removably. The detecting means detects kinds of the developing units attached to said means for forming an image. The color display means has display elements respectively indicating the kinds of the colors of the developers which said detecting means is detectable. The mode selection means selects one of a first mode in which an image forming operation is carried out by selecting any one of the developing units attached to said means for forming an image and a second mode in which an image forming operation is carried out by selecting both of the developing units attached to said means for forming an image. The first display control means drives the display element corresponding to any one of the developing units attached to said means for forming an image when the first mode is selected. The second display control means drives both of the display elements respectively corresponding to the developing units attached to said means for forming an image when the second mode is selected.

In another preferred embodiment of the present invention, there is provided a copying apparatus which comprises a photosensitive member, means for forming an electrostatic latent image, a first developing unit, a second developing unit, a drive means, a color display means, and a display control means. The means for forming an electrostatic latent image forms an electrostatic latent image on the surface of said photosensitive member. The first developing unit has a first developer to develop the electrostatic latent image. The second developing unit has a second developer different in color thereof from a color of the first developer housed in said first developing unit which develops the electrostatic latent image. The drive means drives respectively said first developing unit and said second developing unit in order so as to form a multicolor image. The color display means displays the color of the developer housed in said first developing unit and the color of the developer housed in said second developing unit. The display control means controls said color display means so as to display the color of the developer housed in at least one of said developing unit which is driven.

In another preferred embodiment of the present invention, there is provided a copying apparatus which comprises a photosensitive member, means for forming an electrostatic latent image, a plurality of developing unit, a drive means, a color display means, and a display control means. The means for forming an electrostatic latent image forms an electrostatic latent image on the surface of said photosensitive member. The plurality of developing unit has a developer to develop the electrostatic latent image. Each of the developer housed in each developing unit has a different in color thereof from colors of the developers housed in the remaining developing unit. The drive means drives respectively said developing unit in order so as to form a multicolor image. The color display means displays the color of the developer housed in each developing unit. The display control means controls said display means so as to display the color of the developer housed in at least one of said developing unit which is driven.

In another preferred embodiment of the present invention, there is provided a copying apparatus which comprises means for forming an image, a color display means, a mode selection means, a developing unit selection means, a first display control means, a storing means, a second display control means and a third display control means. The means for forming an image has a plurality of developing units. Each of the developing units houses a developer different in color thereof from colors of the developers of the remaining developing units. The color display means displays the colors of the developer of the developing units. The mode selection means selects one of a first mode in which a monochromatic image forming operation is carried out by selecting any one of the developing units and a second mode in which a multicolor image forming operation is carried out. The developing unit selection means selects any one of the developing units when the first mode is selected by said mode selection means. The first display control means controls said color display means so as to display the color of the developer of the developing unit selected by said developing unit selection means when the first mode is selected by said mode selection means. The storing means stores the color of the developer of the developing unit selected by said developing unit selection means when the first mode is selected by said mode selection means. The second display control means controls said color display means so as to display the color of the developer of the developing unit selected by said developing unit selection means when the second mode is selected, the color being different from the color of the developer of the developing unit when the first mode has been selected. The third display control means controls said display means so as to display the color of the developer of the developing unit means stored by said storing means according to cancellation of the second mode.

Owing to the above described means provided with the copying apparatus, the following advantage is obtained, namely, assuming that a single scan multicolor copy mode is cancelled after the multicolor copying operation is carried out, a developing unit selected in a monochromatic copy mode can be automatically selected, whereby the copying operation continues. In other words, it is unnecessary to check the color of a developer housed in the developing unit used in the monochromatic copy mode each time the single scan multicolor copy mode is cancelled. Thus, the multicolor copy can be operatively and efficiently accomplished by the copying apparatus according to the present invention.

BRIEF DESCRIPTION OF THE DRAWINGS

These and other objects and the feature of the present invention will become apparent from the following description taken in conjunction with the preferred embodiment thereof with reference to the accompanying drawings, in which.

DETAILED DESCRIPTION OF THE INVENTION

Figure 1:
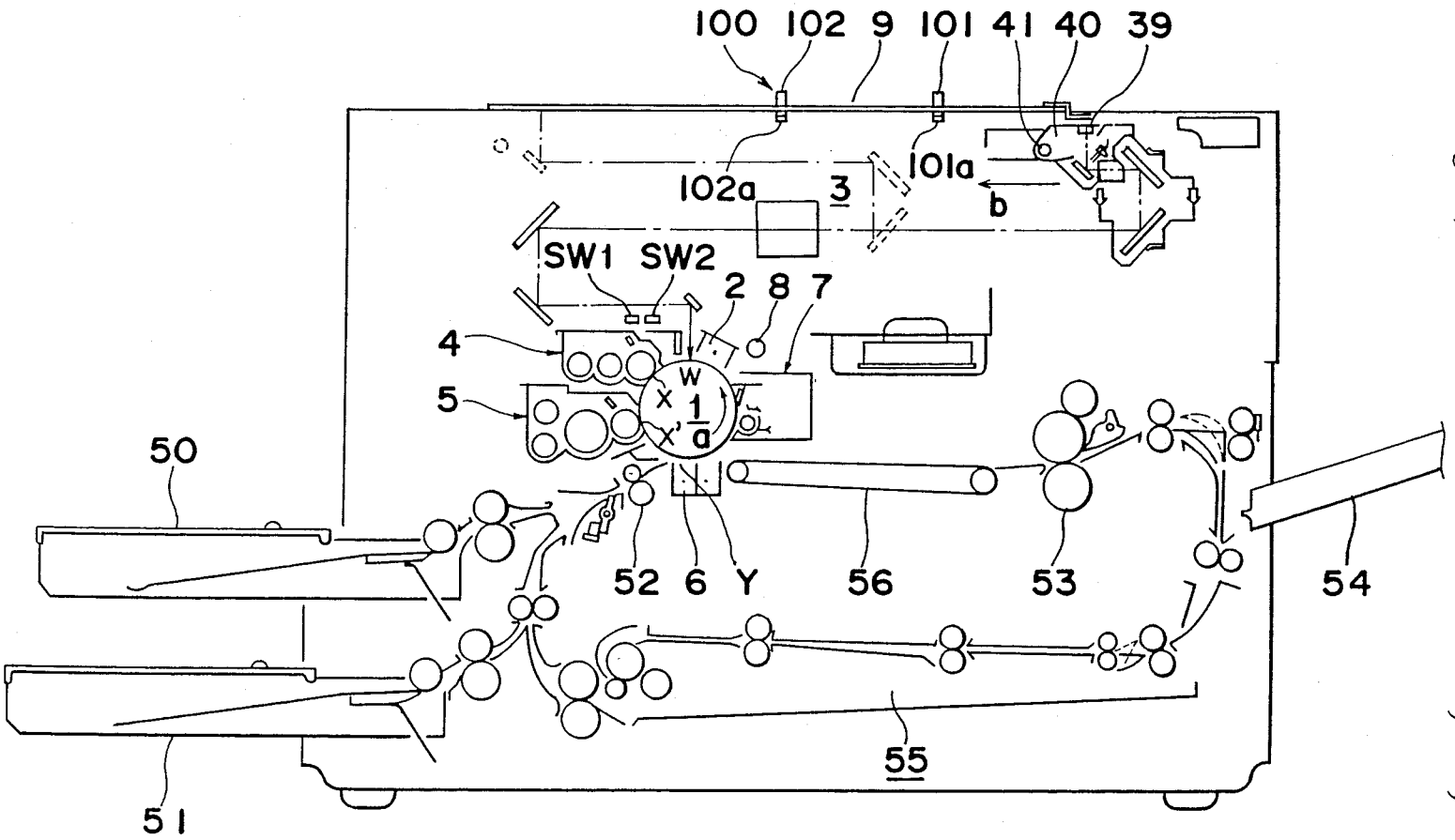
FIG. 1 is a schematic vertical sectional view of the copying apparatus capable of carrying out a single scan two color copying operation.

An embodiment according to the present invention is described: A copying apparatus capable of copying an image of an original document on a copy sheet in two colors by one copy operation (hereinafter referred to as single scan two color copy) is described with reference to the accompanying drawings.

The copying operation of the copying apparatus is briefly described.

When a first mode in which a monochrome copying is carried out by a switching means or a mode selecting means is specified, the following copying operation is performed by a first mode copying operation means. That is, an original document placed on an original document placing plate is exposed by means for forming an electrostatic latent image, and then, an electrostatic latent image corresponding to the image of the original document is formed on an electrostatic latent image holding member or a photosensitive member. Thereafter, the electrostatic latent image is developed by one of the two developing units of a developing means, in means for forming an image, selected by a developing unit selection means or a color specifying means, and then, the image developed is transferred to a material to be copied, supplied by a supply means, by a transfer means. The toner color of the developing unit selected by the developing unit selection means and detected by a detecting means is displayed by a first display means. The means for forming an image comprises the developing means, a drive means driving the developing means, and a drive control means controlling the drive means.

When the first mode is switched by the switching means to the second mode in which a plural color copy is carried out so as to specify the second mode, the following copying operation is carried out by a second mode copying operation means. The original document placed on the original document placing plate is exposed by the means for forming an electrostatic latent image, and an electrostatic latent image corresponding to the image of the original document is formed on the electrostatic latent image holding member, and any one of the two developing units of the developing means is driven by the drive means according to a region specified by a region specifying means so as to develop the electrostatic latent image, and the developed image is transferred onto, a material to be copied, supplied by the supply means. The toner colors of the two developing units detected by the detecting means are displayed by a second display means.

Thereafter, when the second mode is switched to the first mode, since a developing unit selected when the first mode is switched to the second mode is stored by a storing means, the developing unit stored by the storing means is automatically selected by a return control means. The toner color of the developing unit stored by the storing means is displayed by a third display means. Each display means comprises a color display means and a display control means controlling the color display means.

The detailed description of the copying apparatus which carries out the above described operation is described hereinafter.

FIG. 1 is a schematic sectional view of the copying apparatus capable of carrying out the two color copy operation. Its mechanism and standard copy operation of reproducing the image of an original document are described hereinafter.

While a photosensitive drum 1 which serves as the electrostatic latent image holding member, or the photosensitive member, is rotating in the direction shown by an arrow a, the surface of the photosensitive drum 1 is charged by a charger 2.

Thereafter, an original document placed on an original document placing glass 9 is exposed by the means for forming an electrostatic latent image. That is, the document is irradiated by an exposure lamp 41 mounted on a scanner 40 which is scanning the original document in the direction shown by an arrow b, that is, the direction from a scan starting position (shown by a solid line) to a scan ending position (shown by a dotted line). The light reflected from the original document is incident at an exposure point W on the surface of the photosensitive drum 1 through mirrors and a lens. The photosensitive drum 1 is exposed by the light through the exposure point W, thereby an electrostatic latent image corresponding to the original document image being formed on the surface of the photosensitive drum 1.

The electrostatic latent image is developed into a visible image in developing regions X or X' on the surface of the photosensitive drum 1 by a toner supplied by a developing unit. The regions X and X' confront a first developing unit 4 and a second developing unit 5, respectively. Thus, a toner image which has reproduced the image of the original document is formed.

A copy sheet, supplied from either a sheet supply unit 50 or 51 serving as the supply means, is transported by a pair of timing rollers 52 to the space (transfer region Y) between a transfer charger 6 serving as the transfer means and the photosensitive drum 1. The transfer region Y confronts the transfer charger 6. The copy sheet arrives at the transfer region Y synchronously with the toner image which is rotating on the photosensitive drum 1. After the toner image is transferred to the copy sheet, the copy sheet is transported by a transport belt 56 between a pair of fixing rollers 53 where the toner image is melted, and then, fixed to the copy sheet. Thereafter, the copy sheet is discharged to a discharge portion 54.

When the duplex copy mode is selected, the copy sheet is transported to a duplex unit 55 where the copy sheet is turned upside down. Thereafter, it is transported to the transfer region Y again. At this time, the optical system 3 and the photosensitive drum 1 carry out a copying operation similar to that described above so as to form a toner image on the back surface of the copy sheet.

The toner which has remained on the surface of the photosensitive drum 1 is scraped with a cleaning unit 7. The remnant charge of the photosensitive drum 1 is erased by the light irradiated from an eraser lamp 8 in order to prepare the following developments.

According to the copying apparatus, in addition to the above described standard copy operation (first mode), a two colored copy operation, or single scan two colored copy (second mode) can be accomplished by operating the scanner 40 one time. In order to accomplish these operations, the copying apparatus is provided with an image editing mechanism 100. The developing units 4, 5, and an operation panel 70 (refer to FIG. 11) are also provided with specific mechanisms.

The developing units 4 and 5 which serve as the developing means in the means for forming an image are described hereinafter.

The first and second developing units 4 and 5 are detachably attached to the housing of the copying apparatus. These developing units may be replaced with same type developing units which house developers in different colors, respectively. In this embodiment, these developing units 4 and 5 may be suitably replaced with a developing unit which houses a developer consisting of a black toner and a carrier, a developing unit which houses a developer consisting of a red toner and a carrier or a developing unit which houses a developer consisting of a yellow toner and a carrier.

Accordingly, it is necessary for the copying machine to be provided with the detecting means for detecting which of the three colors are housed in the first and the second developing units 4 and 5.

In this embodiment a developing unit housing a black developer is attached to the housing of the copying apparatus as the second developing unit 5 and a developing unit housing a black, red or yellow developer is attached thereto as the first developing unit 4.

In the housing of the copying apparatus, two magnet switches SW1 and SW2 are mounted on the portion on which the first developing unit is attached. Two magnets which confront the switches SW1 and SW2 are mounted on a developing unit which houses the black developer. A magnet which confronts the switch SW1 is mounted on a developing unit which houses the red developer. A magnet which confronts the switch SW2 is mounted on a developing unit which houses the yellow developer. These magnets are not shown in the drawings.

Figures 10, 11:
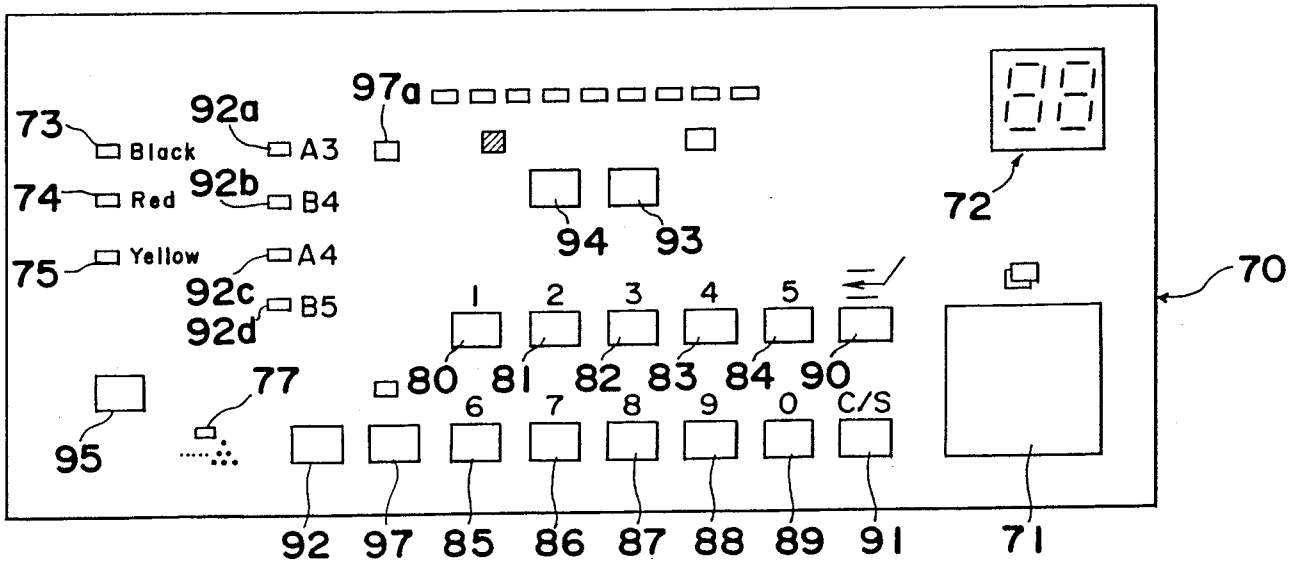
FIG. 10 shows a color code table.
FIG. 11 is a plan view showing the detail of the operation panel 70.

As shown in a color code table in FIG. 10, when a developing unit housing a black developer is attached to the housing of the copying apparatus as the first developing unit 4, the switches SW1 and SW2 are turned on. When a developing unit housing a red developer is attached thereto as the first developing unit 4, only the switch SW1 is turned on, and when a developing unit housing a yellow developer is attached thereto, only the switch SW2 is turned on. When a developing unit is not attached thereto, both the switch SW1 and the SW2 are turned off. The ON/OFF signals are transferred to a micro computer.

Figure 2:
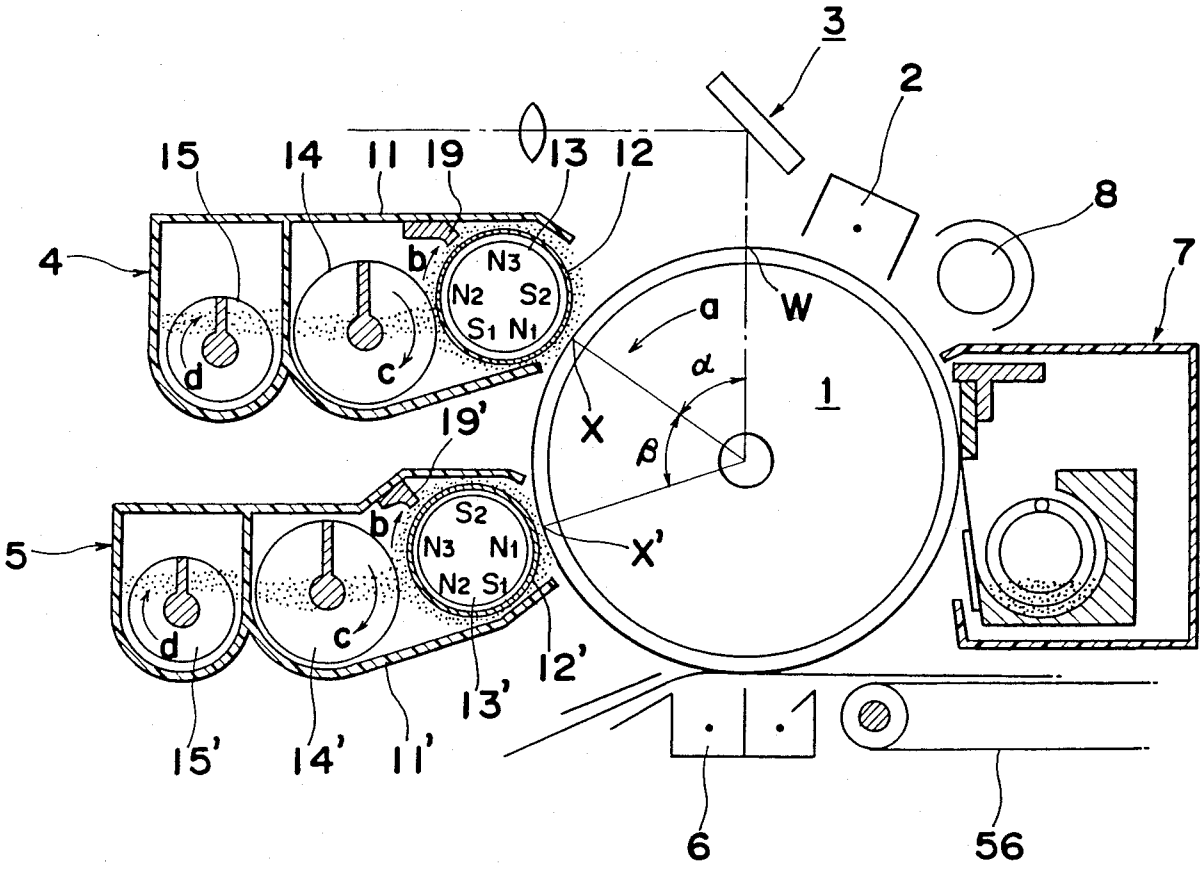
FIG. 2 is a sectional view showing the arrangement and construction of the first and second developing units 4 and 5.

The constructions of the developing units 4 and 5 are almost same as shown in FIG. 2. A developing tank 11 includes a developing sleeve 12, a supply roller 14, and a screw 15. The developing sleeve 12 is disposed adjacent to the photosensitive drum 1. The supply roller 14 is disposed adjacent to the developing sleeve 12 and the screw 15 are disposed adjacent to the supply roller 14.

Slight irregularities are formed by means of sandblasting on the outer circumferential face of the cylindrical (inside diameter 24.5 mm) developing sleeve 12 made of nonmagnetic conductive material. The developing sleeve 12 confronts the photosensitive drum 1 in the developing regions X and X' with a developing gap Ds (=0.6 mm) provided therebetween. The rotation angles from the exposure point W to the developing regions X and X' are set to $\alpha$ and $\alpha+\beta$, respectively ($\alpha=56°$, $\beta=52°$).

A developer height regulating member 19 mounted on the inner face of the top wall of the developing tank 11 confronts the developing sleeve 12 with a developer height regulating gap Db (=0.4 mm) provided therebetween in the portion opposite to the developing region X.

A magnet roller 13 is arranged in the developing sleeve 12. The roller 13 consists of a plurality of magnets extending in the axial direction of the developing sleeve 12. The magnetic forces of magnetic poles N1–N3, S1, and S2 disposed on the outer circumferential face of the magnets are as follows: N1=1,000 G; N2 and N3=500 G; S1 and S2=800 G (G indicates Gauss).

Figure 4:
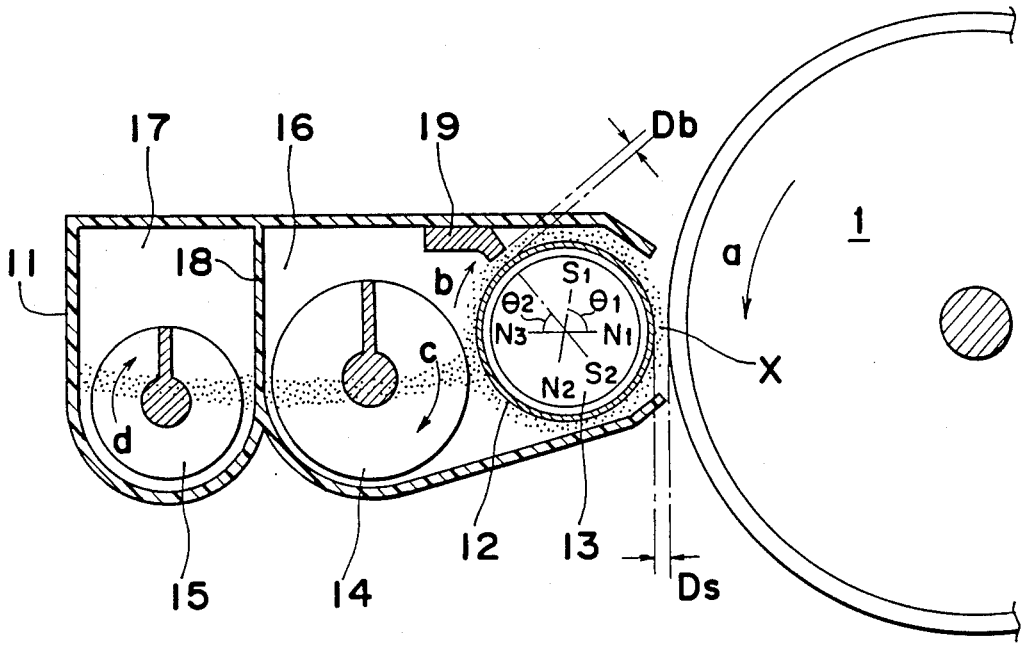
FIG. 4 is a sectional view showing the positions, of the magnetic poles of the magnet roller 13 in the developing unit, where a development can be carried out.

As shown in FIG. 4, the center of the magnetic pole N1 is disposed at the point $\theta 1$ (80°) clockwise from the center of the magnetic pole S1. The center of the magnetic pole N3 is disposed at the point $\theta 2$ (40°) counterclockwise from the portion, of the developing sleeve 12, which confronts the developer height regulating member 19 when the magnetic pole N1 confronts the photosensitive drum 1.

Figure 3:
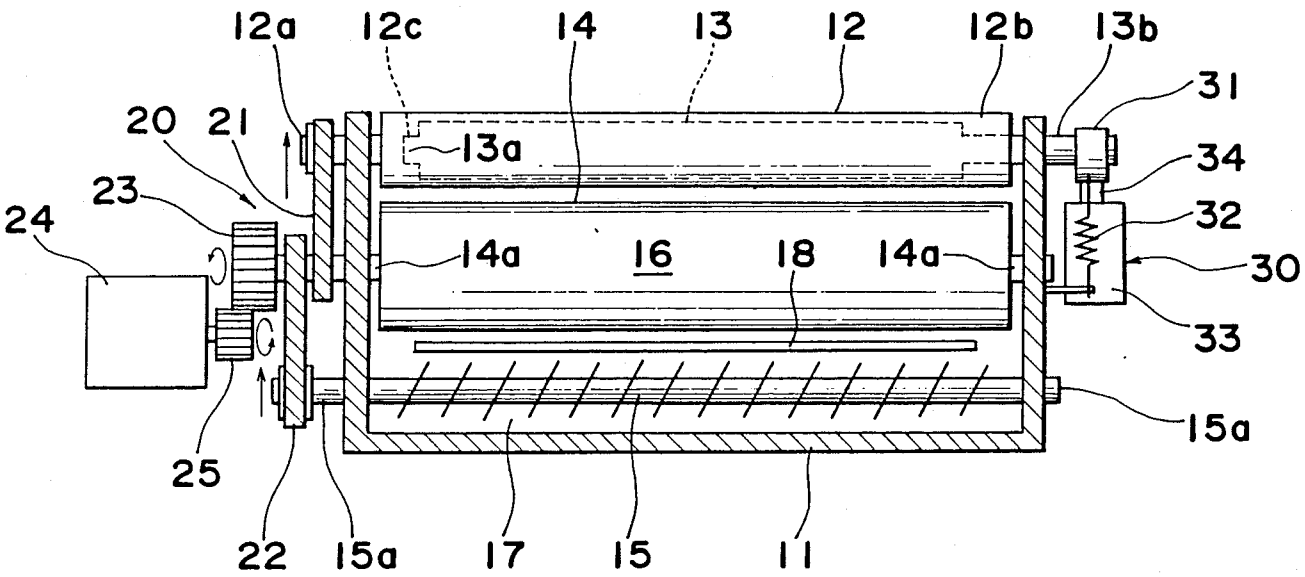
FIG. 3 is a transverse cross sectional view of the first developing unit 4.

As shown in FIG. 3, one end portion 13*a* of the shaft of the magnet roller 13 is supported by a concave 12C, serving as a shaft bearing, mounted in the developing sleeve 12 and the other end portion 13*b* thereof is supported by one of the side walls of the developing tank 11. The magnet roller 13 can be rotated at a certain angle ($\theta 1=40°$) by a moving means 30 described later.

A shaft bearing portion 12*b* of the developing sleeve 12 shown in FIG. 3 is supported by the shaft 13*b* of the magnet roller 13, and the shaft 12*a* opposite to the shaft bearing portion 12*b* is supported by one of the side walls of the developing tank 11. Thus, the developing sleeve 12 can be rotated by a drive means 20.

The supply roller 14 and the screw 15 are disposed on transport passages 16 and 17, respectively partitioned by a partition wall 18, and a shaft 14*a* of the roller 14 and a shaft 15*a* of the screw 15 are respectively supported by one of the side walls of the developing tank 11, thereby the supply roller 14 and the screw 15 being rotated by the drive means 20.

The transport passage 16 is communicated with the transport passage 17 in the vicinity of both of the side walls of the developing tank 11 as shown in FIG. 3.

The drive means 20 for driving the developing units 4 and 5, the supply roller 14, and the screw 15 is described hereinafter.

As shown in FIG. 3, a belt 21 is spanned between the shaft 12*a* of the developing sleeve 12 and the shaft 14*a* of the supply roller 14. A belt 22 is also spanned between the shaft 14*a* of the supply roller 14 and the shaft 15*a* of the screw 15.

A gear 23 is mounted on one end of the shaft 14*a* of the supply roller 14. The gear 23 is engaged with a drive gear 25 of a motor 24.

According to tis construction, when the drive gear 25 is rotated by the motor 24 in the direction shown by an arrow of a solid line, the gear 23, and the belts 21, 22 are rotated, respectively in the directions as shown by the arrows of solid lines, which causes to rotate the developing sleeve 12, the supply roller 14, and the screw 15 in the directions shown by arrows b, c, and d. The rotating speed of the developing sleeve 12 is 240 r.p.m.

Figure 5:
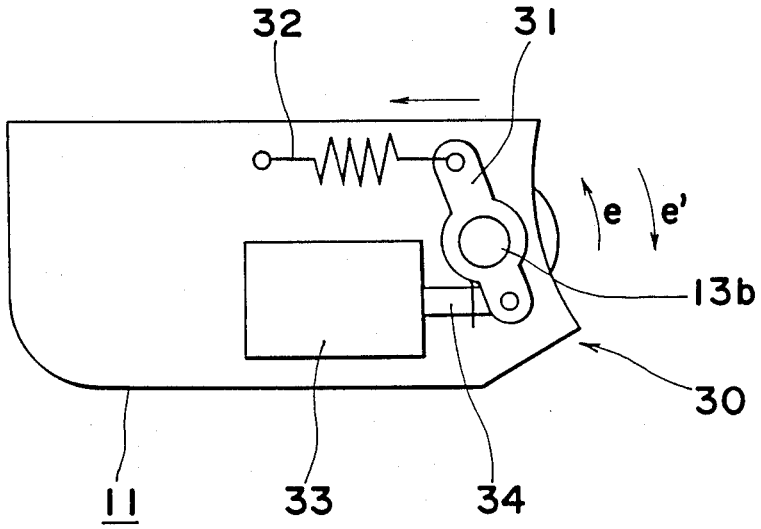
FIG. 5 is a front view showing the drive condition of the moving means 30 for moving the magnet roller 13.
Figure 7:
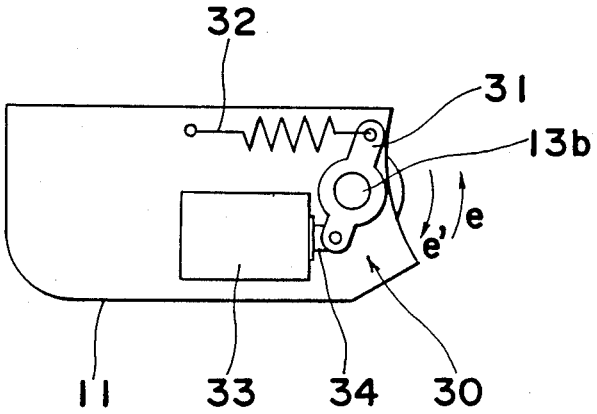
FIG. 7 is a front view of the moving means 30 when the moving means 30 is not in operation.

The moving means 30 for driving the magnet roller 3 constitutes the drive means and comprises a lever 31, a spring 32, and a solenoid 33 as shown in FIGS. 5 and 7. The lever 31 is fixed to one end of the shaft 13*b* of the roller 3. One end of the lever 31 is fixed to one end of the spring 32 fixed to the developing tank 11. The lever 31 is always urged by the spring 32 in the direction shown by an arrow e. A plunger 34 for the solenoid 33 is fixed to the other end of the lever 31. When the solenoid 33 is driven, the lever 31 is rotated in the direction shown by an arrow e' against the urging force of the spring 32.

When the solenoid 33 is not drive, namely, when the lever 31 is positioned as shown in FIG. 5, the magnetic pole N1 of the magnet roller 13 confronts the photosensitive drum 1 and the magnetic pole N3 is at the position $\theta 2$ (40°) counterclockwise from the portion, of the developing sleeve 12, which confronts the developer height regulating member 19 as shown in FIG. 4.

Figure 6:
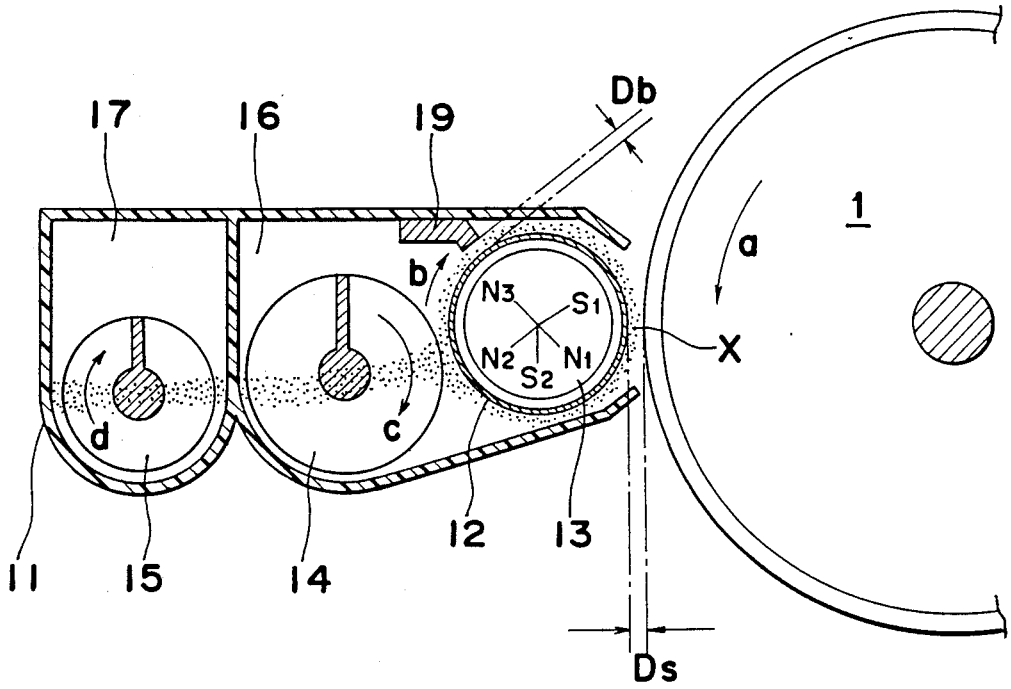
FIG. 6 is a sectional view showing the positions of the magnetic poles of the magnet roller 13 which has completed a development.

When the solenoid 33 is driven, namely, when the lever 31 is positioned as shown in FIG. 7, the magnetic pole N3 confronts the developer height regulating member 19 and the middle point between the magnetic poles N1 and S1 confronts the photosensitive drum 1 as shown in FIG. 6.

The image editing mechanism 100 is described hereinafter.

Figure 8:
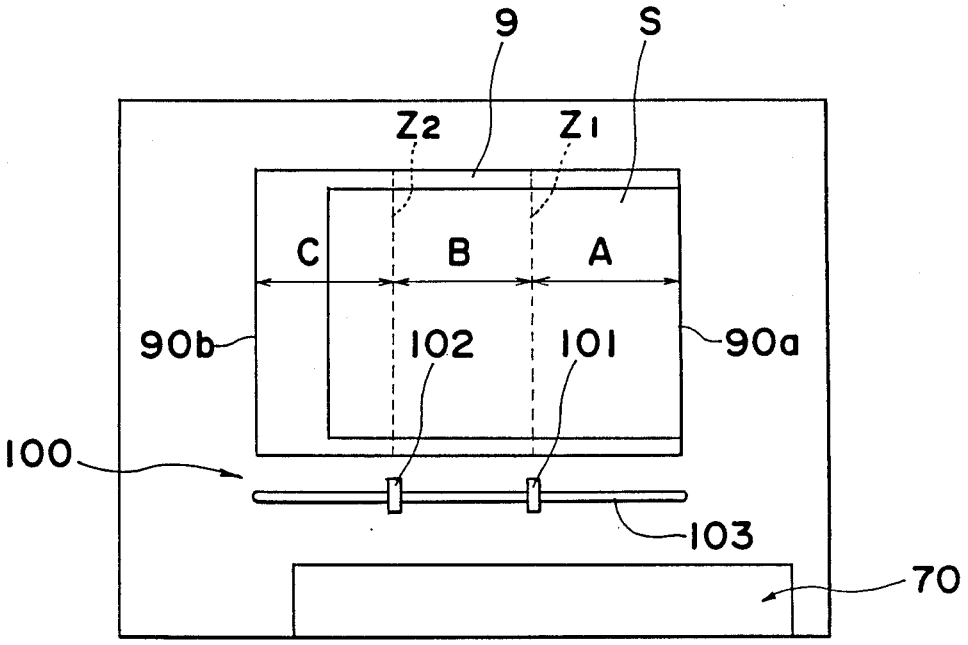
FIG. 8 is a plan view showing the editing mechanism 100.
Figure 9:
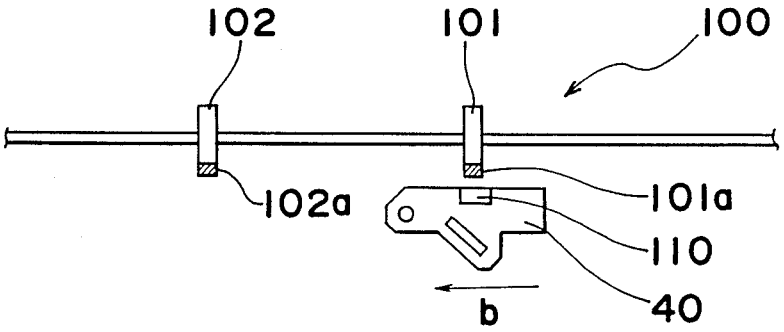
FIG. 9 is a front view showing the relationship between the first and second levers 101 and 102 of the editing mechanism 100 and the reed switch 110 of the scanner

First, the region specifying means of the mechanism 100 is described. Referring to FIGS. 8 and 9, first and second levers 101, 102 of the image editing mechanism 100 specify, regions to be copied (hereinafter referred to as regions), by dividing the original document placing face, or the surface of the original document placing glass 9 in the direction (shown by an arrow b) in which the scanner 40 moves and also specify a color to be reproduced. The levers 101 and 102 are mounted on the side portion of the glass 9 so as to slidable along a guide groove 103 formed in the direction in which the scanner 40 moves. Magnets 101*a* and 102*a* are respectively provided at the lower ends, of the levers 101 and 102, which are positioned in the housing of the copying apparatus.

When the positions of the levers 101 and 102 are set as shown in FIG. 8, regions are specified as follows: The area between one end 90*a* of the original document placing glass 9 and the first lever 101 is specified as a region A. The area between the first lever 101 and the second lever 102 is specified as a region B. The area between the second lever 102 and the other end 90*b* of the original document placing glass 9 is specified as a region C. The regions A and C are specified to be reproduced in black and white, and the region B not in monochrome (red or yellow).

When a reed switch 110 mounted on the scanner 40 of the optical system 3 detects magnets 101*a* and 102*a* during a scanning operation, the read switch outputs a detecting signal to the microcomputer. In response to the signal, the drive means drives either the first developing unit 4 or the second developing unit 5 so as to develop.

The operation panel 70 of the copying apparatus is described with reference to FIG. 11.

On the operation panel 70, reference numeral 71 denotes a print key; 72, numeral indication LED for indicating the number of sheets to be copied; 73–75, toner color indication LEDs, serving as the color display means, for indicating black, red, and yellow; 77, toner emptiness indication LED; 80–89, ten keys; 90, interruption key for issuing an interruption; 91, clearing key for clearing a condition set previously; 92, paper selection key; 92*a*–92*d*, paper selection indication LEDs for indicating paper size of A3, B4, A4, and B5; 93 and 94, image density up key and image density down key, respectively.

Reference numeral 95 denotes a key for serving as a part of the means for selecting the developing unit, or the color specifying means, 4 or 5 to be used in the first mode. Reference numeral 97 denotes a key for selecting the single scan two color copy mode. Numeral 97*a* denotes the single scan two color copy mode indication LED for indicating that the single scan two color copy mode selection key is ON. The developing unit selection key 95 can be selected by the color of a developer according to the embodiment, however, it may be selected according to the position of the developing units in a vertical direction.

Figure 12:
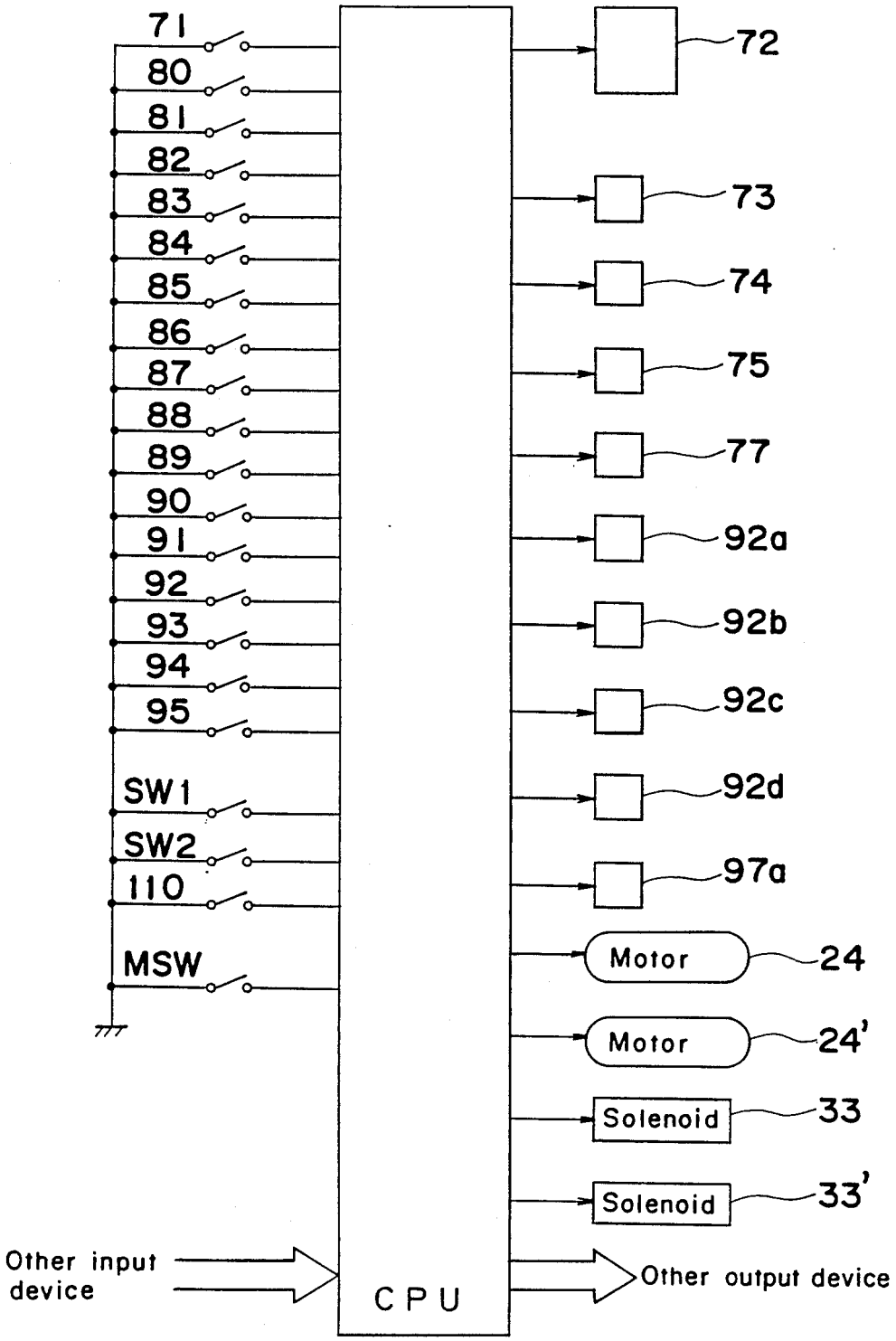
FIG. 12 is a diagram of a control circuit for controlling a copy operation.

Referring to FIG. 12, a control circuit construction in which the microcomputer is an important component is described hereinafter.

The switches SW1, SW2, and 110, switches of the key 71 and 80–95, and a main switch MSW are respectively connected to a central processing unit (CPU) of the microcomputer. The LEDs 72–75, 77, 92*a*, 92b, 92*c*, 92*d* and 97*a* are respectively connected to the CPU. The motor 24 and the solenoid 33 are respectively connected to the CPU. A motor 24' and a solenoid 33' which are described below are respectively connected to the CPU. An other input device and an other output device are respectively connected to the CPU.

The control operation which is carried out by the microcomputer is described with reference to FIGS. 13 through 17. The first mode copying operation means, the second mode copying operation means, the storing means, the drive control means, and the return control means are respectively driven by the microcomputer.

Figure 13:
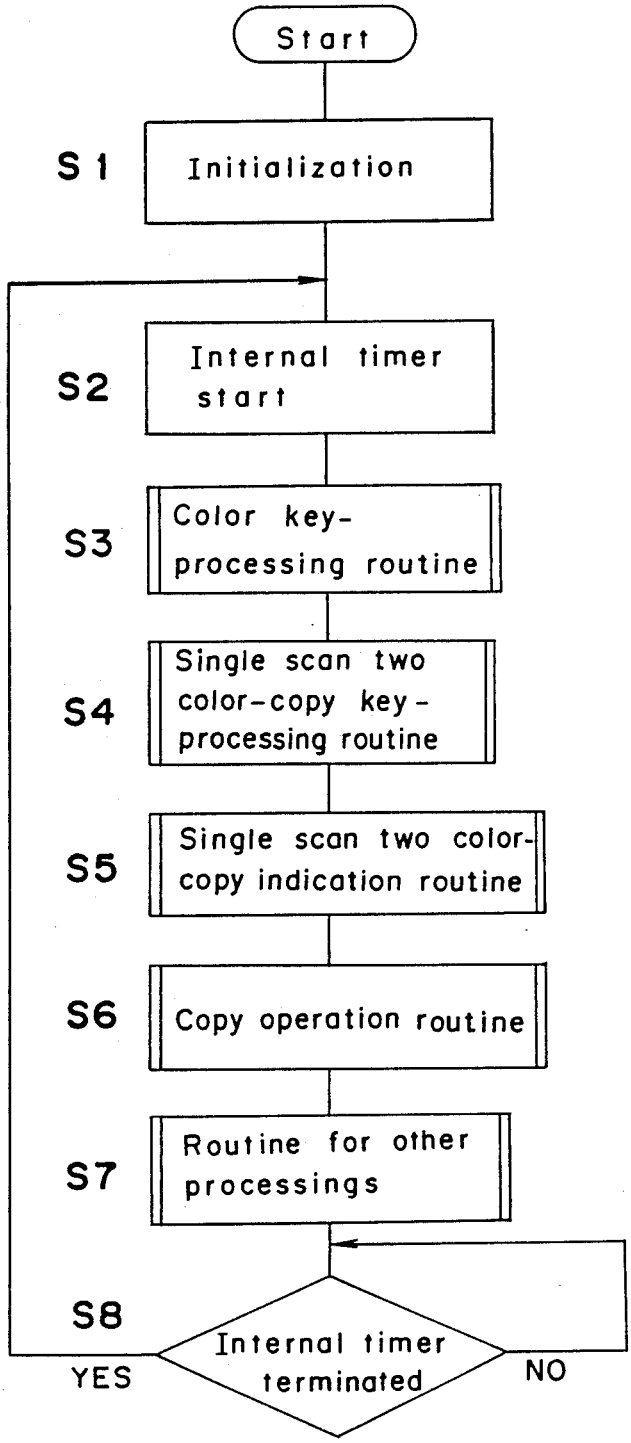
FIG. 13 is a flow chart of a main routine.

The main routine shown in FIG. 13 illustrates the process of controlling the whole copying apparatus. The power switch of the copying apparatus is turned on, the microcomputer mounted in the copying machine is initialized at step S1.

At step S2, an internal timer is set, and a period in which each of the following processes is performed by the routine is set, namely, in the copying apparatus according to the embodiment, each step of the routine carries out its process in a very short period.

At step S3, a color key processing is executed, at step S4, a single scan two color copy key processing is executed, a single scan two color copy indication is executed, each operation of these routines is described later.

At step S6, a copy operation routine is executed: The standard copying operation (first mode copying operation means) or the single scan two color copying operation (the second mode copying operation means) is executed, which is described later.

At step S7, other process is executed. At step S8, it is detected whether or not the internal timer set at step S2 has terminated its operation. If it is detected that the timer has terminated its operation, the program returns to step S2. If it is detected that it has not terminated, the program waits at step S8.

The color key processing routine S3 which serves as the developing unit selection means or the color specifying means is described hereinafter. A part of the routine S3 serves as the first display control means.

Figure 14:
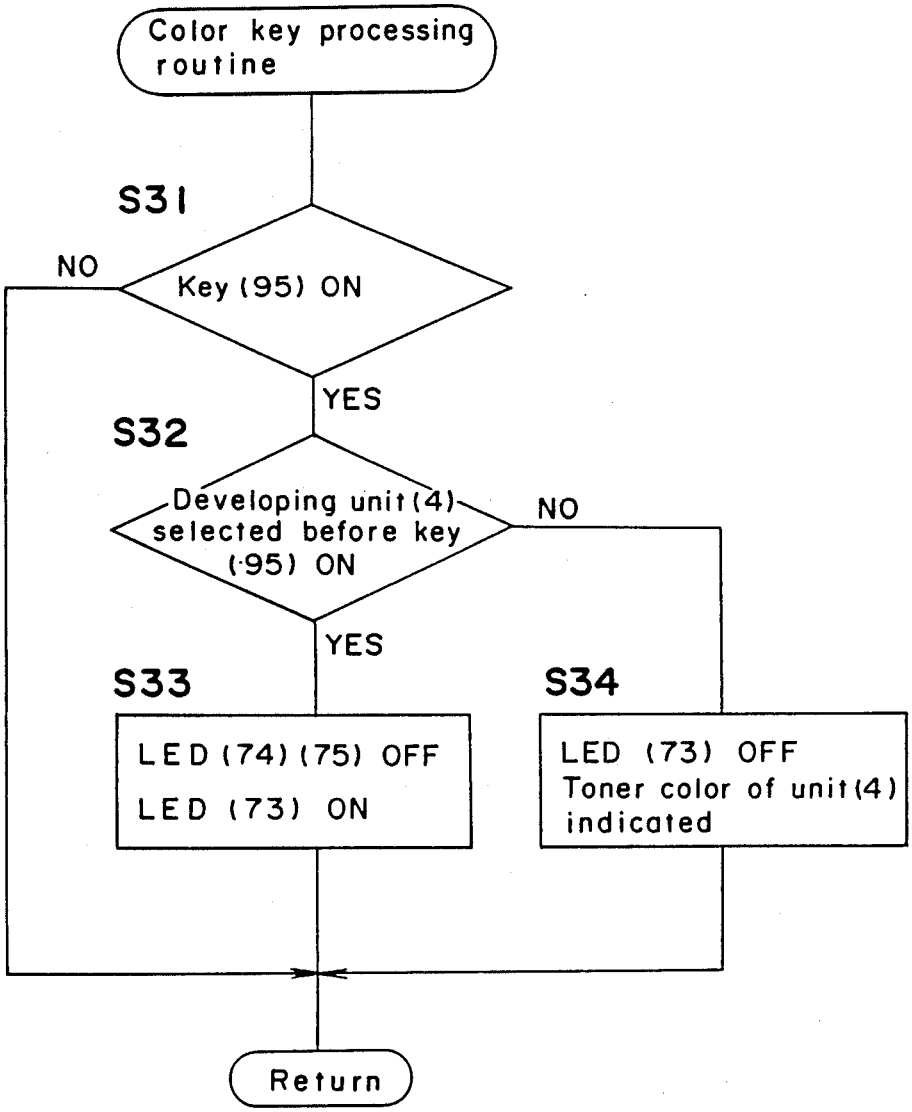
FIG. 14 is a flow chart showing a color key processing routine.

Referring to FIG. 14, at step S31, it is detected whether or not the developing unit selection key 95 has turned on. If NO, the program returns. If YES, the program advances to step S32. At step S32, it is detected whether or not the first developing unit 4 mounted on the housing of the copying apparatus at the upper portion thereof has been selected before it is detected at step S31 that the developing unit selection key 95 has been turned on. If YES, a command is issued at step S33 that the red indication LED 74 and the yellow indication LED 75 are turned off and the black indication LED 73 is turned on. If NO, a command is issued at step S34 that the LED 73 is turned off and the LED, which indicates the color of a toner housed in a developing unit mounted on the housing of the copying apparatus as the first developing unit 4, is turned on.

The toner color of the first developing unit 4 is detected according to the color code table shown in FIG. 10 by the ON/OFF signals inputted by the switches SW1 and SW2 to the microcomputer.

Thus, when the selection key 95 is turned on according to the color key processing routine with the black indication LED 73 turning on, the red indication LED 74 or the yellow indication LED 75 is turned on according to the toner color of the developing unit which is used as the first developing unit 4.

When the selection key 95 is turned on with the red indication LED 74 or yellow LED 75 turning off, the black indication LED 73 is turned on.

The single scan two color copy key processing routine S4 which serves as the mode selection means and the switching means is described hereinafter. A part of the routine S4 also serves as the second display control means.

Figure 15:
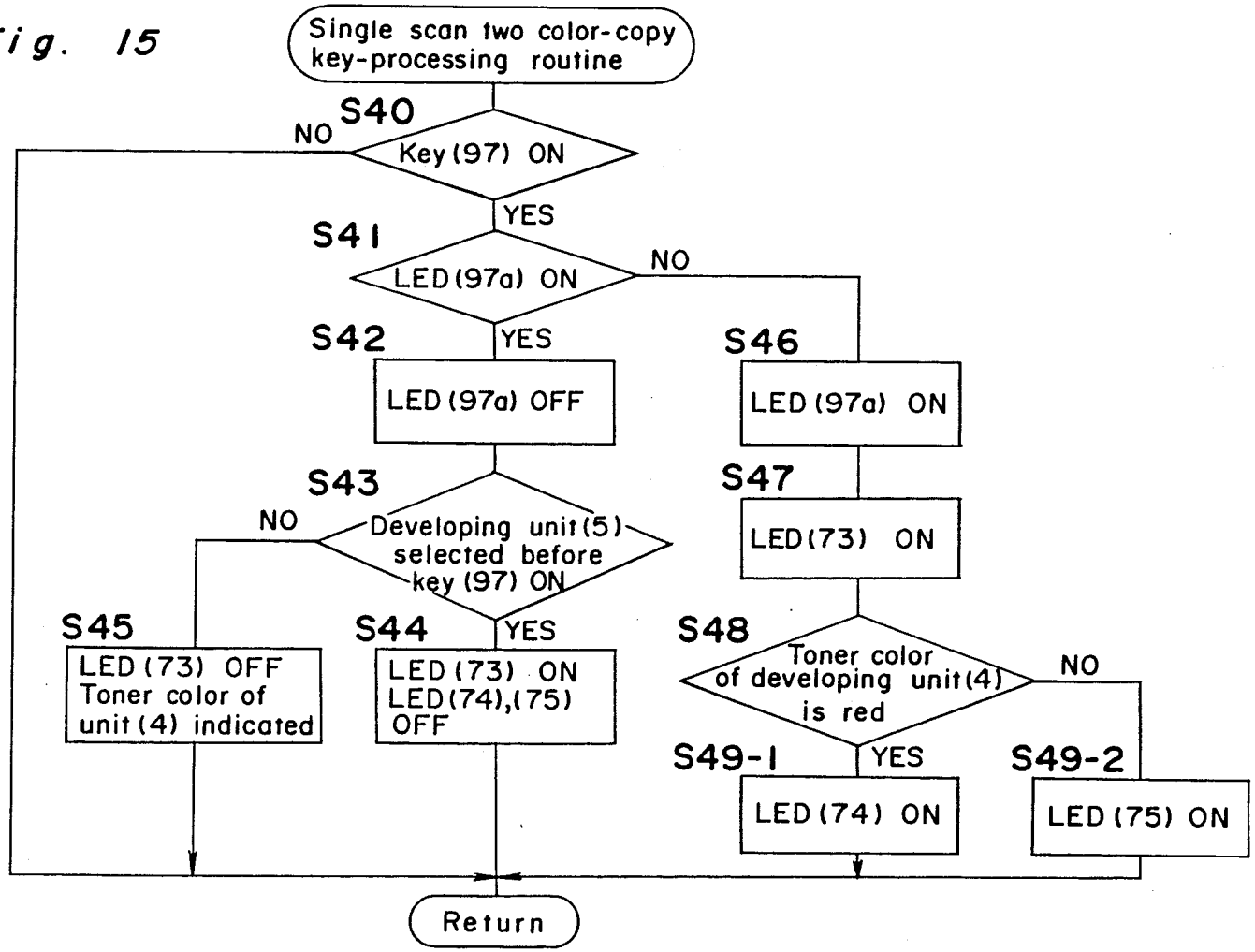
FIG. 15 is a flow chart showing a single scan two color copy mode selection key processing routine.

Referring to FIG. 15, it is detected at step S40 whether or not the single scan two color copy mode selection key 97 has turned on. If NO, the program returns. If YES, the program advances to step S41. At step 41, it is detected whether or not the single scan color copy mode indication LED 97*a* has turned on.

If the LED 97*a* has turned on, a command is issued at step 42 that the LED 97*a* is turned off so as to cancel the single scan two color copy mode. Then, it is detected whether or not the second developing unit 5 has been selected before the key 97 is turned on at step 43. If YES, the program advances to step 44 and a command is issued that the black indication LED 73 is turned on and the red indication LED 74 and the yellow indication LED 75 are turned off at step 44. If NO, a command is issued that the black indication LED 73 is turned off and the toner color of the first developing unit 5 is indicated at step 45.

The toner color of the first developing unit 4 is detected according to the color code table shown in FIG. 10 by the ON/OFF signals transferred to the microcomputer by the switches SW1 and SW2.

When it is detected at step S41 that the single scan two color copy mode indication LED 97*a* is turned off, the program advances to step 46. A command is issued at step S46 that the LED 97*a* is turned on so that the copy mode goes into the single scan two color copy mode. At step S47, the black indication LED 73 is turned on.

At step 48, it is detected whether or not the toner color of the first developing unit 4 is red by the ON/-OFF signals outputted from the switches SW1 and SW2. If the color is red, a command is issued at step 49 - 1 that the red indication LED 74 is turned on. If the color is not red and is yellow, it is detected that the developing unit housed the yellow developer is attached to the housing of the copying apparatus serves as the first developing unit 4. Then, the program advances to step 49 - 2 and a command is issued that the yellow indication LED 75 is turned on.

According to the above described process, when the single scan two color copy mode selection key 97 is turned on, all toner colors of the developing units 4 and 5 are indicated on the panel 70 by turning on the color indication LEDs according to the developing units.

The single scan two color copy indication routine S5 which serves as a part of the second control means is described hereinafter.

Figure 16:
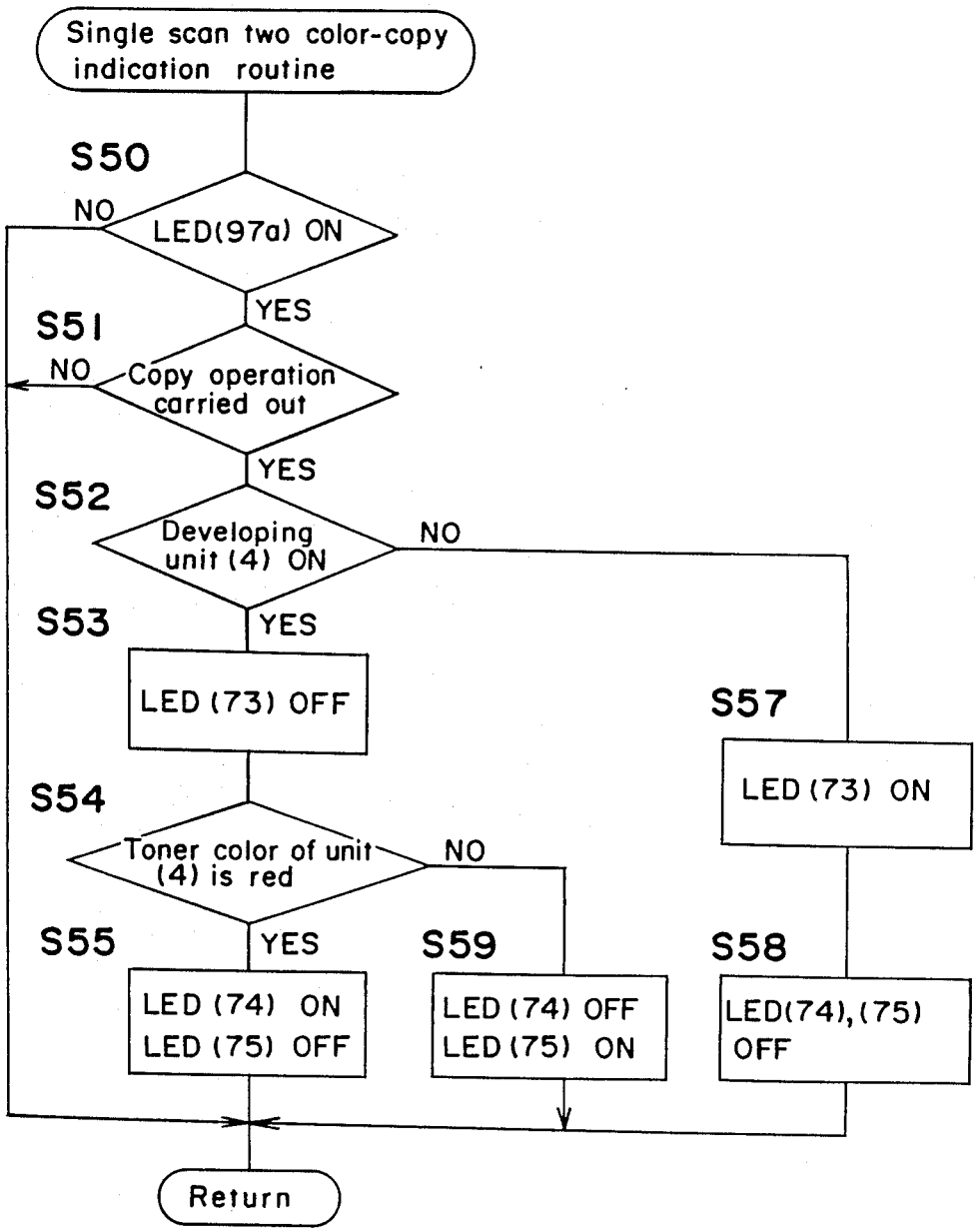
FIG. 16 is a flow chart showing a single scan two color copy indication routine.

Referring to FIG. 16, it is detected at step 50 whether or not the single scan two color copying mode indication LED 97*a* has turned on. If NO, the program returns. If YES, the program advances to step S51. At step S51, it is detected whether or not the single scan two color copy operation is carried out so as to decide whether or not the developing unit 4 or 5 is driven to develop. If neither the developing units 4 nor 5 is driven, the program returns. If either the developing unit 4 or 5 is driven, a command is issued at step 52 that it is detected whether or not the developing unit 4 is driven. If NO, as the second developing unit 5 is driven, a command is issued that the yellow indication LED 74 and the red indication LED 75 are turned off at step 58 after the black indication LED 73 is turned on at step 57.

If the first developing unit 4 is driven at step 52, as the second developing unit 5 is not driven to develop, a command is issued at step 53 that after the LED 73 is turned off, the program advances to step 54.

At step 54, it is detected whether or not the toner color of the first developing unit 4 is red. If the color is red, a command is issued at step 55 that the red indication LED 74 is turned on and the yellow indication LED 75 is turned off. If the color is not red, a command is issued at step 59 that the red indication LED 74 is turned off and the yellow indication LED 75 is turned on.

According to the above described process, when the single scan two color copy mode is carried out, the toner color of the driving developing unit is indicated on the panel 70 by turning on the color indication LED according to the developing unit.

Figure 17:
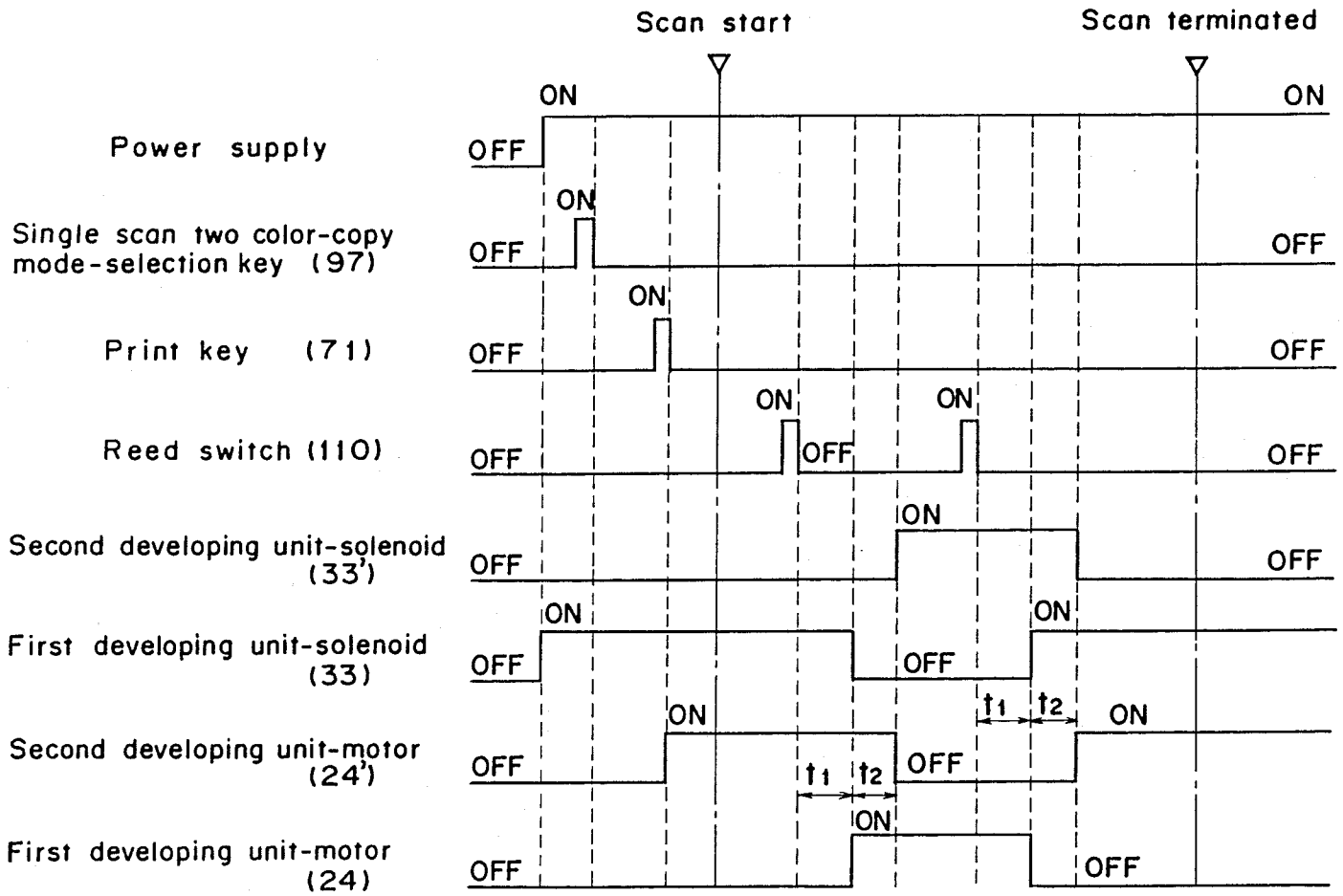
FIG. 17 is a timing chart showing a single scan two color copying operation.

The operation of the single scan two color copy mode is described with reference to the timing chart shown in FIG. 17. It is to be noted that the mark (') is given to the reference numerals of the components of the second developing unit 5.

When the main switch (MSW) of the copying apparatus is turned on, as shown in FIG. 6, the middle portion between the magnetic poles N1 and S1 of the first developing unit 4 confronts the photosensitive drum 1, while in the second developing unit 5, as shown in FIG. 4, the magnetic pole N1 confronts the photosensitive drum 1.

When the print key 71 is turned on in this state, the second developing unit 5 housing a black toner is automatically driven, thereby the standard copying operation being carried out. When the single scan two color copy mode selection key 97 is turned on in this state, the single scan two color copy mode which is described below is allowed to go into an executable condition. It is to be noted, however, that pressing the single scan two color copy mode selection key 97 during a copying operation does not allow the copy mode to go into the single scan two color copy mode.

When the single scan two color copy mode selection key 97 is turned on, the copy mode is switched from the standard copy mode, namely, the first copy mode, to the single scan two color copy mode.

In this state, the first and second levers 101 and 102 are slid along the slide groove 103 so as to specify the image of the regions A and C to be reproduced in monochrome and the image of the region B to be reproduced in color as shown in FIG. 8.

The levers 101 and 102 function only when the single scan two color copy mode is specified, thus can not function other than that state.

When the print key 71 is turned on in the state as described above with an original document S placed on the original document placing glass 9, as shown in FIG. 8, the motor 24' of the second developing unit 5 starts by the drive control means, whereby a developing sleeve 12', a supply roller 14', and a screw 15' are rotated in the directions b, c, and d shown by arrows.

Caused by the operations of these components of the second developing unit 5, the developer, containing a black toner, housed in a developing tank 11' is mixed and stirred by the rotations of the supply roller 14' and the screw 15' while the developer is being transported along the transport passages 16' and 17'. During the transportation, part of the developer is supplied to the surface of the developing sleeve 12' by the supply roller 14' so as to form magnetic brushes on the developing sleeve 12'.

The developer in the form of a magnetic brush is fed to the developing region X' by the rotation of the developing sleeve 12', with a specified amount of developer which is regulated by a developer height regulating member 19' and passes through a space of the developer height regulating gap Db, being prevented from passing therethrough. Thereafter, the developer is sequentially transported to the developing region X' and thus an electrostatic latent image formed on the photosensitive drum 1, of the region X', is developed by the developer.

When the print key 71 is turned on, the scanner 40 starts scanning the image of the original document S in the direction shown by the arrow b. The surface of the photosensitive drum 1 is irradiated by the light reflected from the original document S placed on the original document placing glass 9 through the exposure point W, thus an electrostatic latent image being formed. Thereafter, the second developing unit 5 starts developing the electrostatic latent image.

When the magnet 101*a* of the first lever 101 is detected by the reed switch 110 mounted on the scanner 40, a signal is inputted by the reed switch 110 to the microcomputer.

At this time, the electrostatic latent image, corresponding to the boundary Z1, between the region A and the region B, at which the copy mode is changed from the first copy mode to the second copy mode, namely, from black to colors (red or yellow) is positioned at the exposure point W on the photosensitive drum 1. During the period (t1=0.22 sec) in which the boundary Z1 moves from the exposure point W to the developing region X of the first developing unit 4, only the second developing unit 5 operates.

When the boundary Z1 of the electrostatic latent image reaches the developing region X after the time t1 in relation to the time when the reed switch 110 is turned on, the motor 24 of the first developing unit 4 is turned on and the solenoid 33 for the first developing unit 4 is turned off by the drive control means.

Followed by this operation, the first developing unit 4 is set to the condition as shown in FIGS. 4 and 5 as in the case of the second developing unit 5, that is, the developing sleeve 12, the supply roller 14, and the screw 15 rotate in the directions shown by the arrows b, c, and d, with the result that a magnetic brush is formed on the surface of the developing sleeve 12 and the electrostatic latent image formed on the photosensitive drum 1 is ready to be developed. Thereafter, the first developing unit 4 starts supplying a color toner (red or yellow) to the electrostatic latent image corresponding to the region B.

After passing the time t2 from the start of the first developing motor 24, namely, after passing the period (t=0.2 sec) in which the boundary Z1 of the electrostatic latent image has moved from the developing region X of the first developing unit to the developing region X' of the second developing unit 5, the motor 24' of the second developing unit 5 is turned off and the solenoid 33' for the second developing unit 5 is turned on by the drive control means, whereby the second developing unit 5 is set to the state as shown in FIGS. 6 and 7, and the middle portion between the magnetic poles N1 and S1 confronts the photosensitive drum 1, and the developing sleeve 12, the supply roller 14, and the screw 15 stop rotations. Thus, the developing operation of the image of the region A by a black toner is completed.

When the scanner 40 further moves and reaches the position where the second lever 102 is, namely, when the scanner 40 is at the boundary Z2 between the regions B and C, the reed switch 110 is turned on upon detection of the magnet 102*a* and a signal is inputted to the microcomputer. At this time, the electrostatic latent image corresponding to the boundary Z2 is positioned at the exposure point W.

At the time t1 after the reed switch 110 has been turned on, namely, when the electrostatic latent image of the boundary Z2 has arrived at the developing region X, the motor 24 of the first developing unit 4 is turned off and the solenoid 33 for the first developing unit 4 is turned on. Thus, the developing operation of the image of the region B in color is completed.

At the time t2 thereafter, namely, when the boundary Z2 of the electrostatic latent image which has positioned at the developing region X has arrived at the developing region X' of the second developing unit 5, the motor 24' of the second developing unit 5 is turned on and the solenoid 33' for the second developing unit 5 is turned off, thereby the second developing unit 5 starting developing the image of the region C in black.

The above described operation is maintained until the scanner 40 completes its operation and the development of the image of the region C is completed.

As apparent from the foregoing description, the image of a region of an original document can be copied in black, and the image of a region can be copied in color (red or yellow), and that of a region can be copied in black. Thus, the image of the original document can be copied in two colors during one scanning operation of the scanner 40.

After the above operation is carried out, assuming that a single scan multicolor copy mode is cancelled, a developing unit selected in a monochromatic copy mode and stored by the storing means can be automatically selected by the return control means, whereby the copying operation continues. At this time, the toner color of the developer of the developing unit is displayed by the third display control means.

As described above, the image of the original document is developed in two colors, that is, in the order of black, other color, and black, during one scanning operation, however, the image of the original document can be edited in manners different from that according to the embodiment: The image of the original document can be developed, for example, by increasing the number of levers reversing the start timing of the developing units 4 and 5.

According to the embodiment described above, two developing units 4 and 5 are mounted in the periphery of the photosensitive drum 1 so as to obtain a two color copy (second mode), however, the photosensitive drum 1 may be provided with three or four developing units in the periphery thereof so as to copy the image of the original document in three or four colors.

According to the embodiment, when no developments are carried out, the motor 24 is stopped and the magnetic roller 13 is rotated so as not to allow the magnetic pole to be present in the developing region X, and the magnetic pole is moved to the point where the magnetic pole confronts the developer height regulating member 19, however, a single scan multicolor copy can be made even though the position of the magnetic pole is not changed. It is preferable to change the positions of the magnetic poles because the probability of the contact of a magnetic brush with the photosensitive drum 1 can be reduced, namely, a color mixture does not occur.

In the embodiment, a developing unit which houses a black developer is used as the second developing unit 5 and a developing unit which houses a red developer or a yellow developer is selectively used as the first developing unit 4. But a single scan multicolor copy can be accomplished by mounting a developing unit which houses a red, yellow or black developer may be used as the first or the second developing unit. By doing so, the image of the original document can be copied in red and yellow instead of black and red or black and yellow.

According to the embodiment, the original document placing glass 9 is not moved and the exposure lamp 41 is moved to scan the image of an original document, however, a two color copy can be preferably performed by not moving the exposure lamp 41 and moving the original document placing glass 9 so as to scan the original document.

Furthermore, according to the embodiment, the single scan two color copy mode selection key 97 is turned on, whereby the toner colors of the first developing unit 4 and the second developing unit 5 being indicated in no copy operation and the toner color of the driving developing unit being indicated in the copy operation, however, the toner color of the developing unit can be carried out in manners different from such an indication. For example, when the key 97 is pressed, both toner colors of the first developing unit 4 and the second developing unit 5 can be indicated and when the key 97 is cancelled to press, after all of the LED 73, 74 and 75 are turned off, the toner color of the driving developing unit can be indicated in the copy operation. Also, the key 97 is turned on, whereby the LEDs according to the toner colors of the first developing unit 4 and the second developing unit 5 can be turned on in no copy operation and the LED according to the toner color of the driving developing unit can be flashed in the copy operation.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A copying apparatus comprising:

an original document placing plate which is disposed at a predetermined place of a housing of the copying apparatus and on which an original document is placed;

an electrostatic latent image holding member rotatably supported in the housing of the copying apparatus;

means for forming an electrostatic latent image, disposed in the vicinity of said original document placing plate, for exposing an image of the original document placed on said original document placing plate so as to form an electrostatic latent image, corresponding to the image of the original document, on said electrostatic latent image holding member;

a developing means which is disposed in the periphery of said electrostatic latent image holding member in the housing of the copying apparatus, and has at least a first developing unit housing a first developer and a second developing unit housing a second developer different in the color thereof from the color of the first developer housed in the first developing unit;

a supply means, disposed at a predetermined place of the housing of the copying apparatus, for supplying a material to be copied sequentially to said electrostatic latent image holding member;

a transfer means, disposed in the periphery of said electrostatic latent image holding member in the housing of the copying apparatus, for transferring the developed image to the material to be copied supplied by said supply means;

a switching means for switching a copy mode from a first mode in which a monochrome copying operation is carried out by selecting any one of the developing units to a second mode in which a plural color copying operation is carried out during one image exposure operation and vice versa;

a developing unit selection means for selecting and specifying any one of the developing units when the first mode is specified by said switching means;

a first mode copying operation means for carrying out a monochrome copying operation when the first mode is specified by said switching means;

a region specifying means for specifying a region of the original document image to be developed by the first developer so as to be copied and a region of the original document image to be developed by the second developer so as to be copied;

a drive means for driving either the first developing unit or the second developing unit during one image exposure operation according to a region specified by said region specifying means in the housing of the copying apparatus so as to supply said electrostatic latent image holding member with the developer housed either in the first developing unit or in the second developing unit so as to develop the electrostatic latent image formed on said electrostatic latent image holding member;

a second mode copying means for carrying out a copying operation in the second mode when the second mode is specified by said switching means;

a storing means for storing a developing unit which has been selected in the first mode when a copy mode is switched by said switching means from the first mode to the second mode;

a return control means for automatically selecting a developing unit stored by said storing means when a copy mode is switched from the second mode to the first mode by said switching means.

2. A copying apparatus as claimed in claim 1, wherein said developing unit selection means selects a developing unit according to the color of a developer housed in a developer.

3. A copying apparatus comprising:

an original document placing plate which is disposed at a predetermined place of a housing of the copying apparatus and on which an original document is placed;

an electrostatic latent image holding member rotatably supported in the housing of the copying apparatus;

means for forming an electrostatic latent image, disposed in the vicinity of said original document placing plate, for exposing an image of the original document placed on said original document placing plate so as to form an electrostatic latent image, corresponding to the image of the original document, on said electrostatic latent image holding member;

a developing means which is disposed in the periphery of said electrostatic latent image holding member in the housing of the copying apparatus, and has at least a first developing unit housing a first developer and a second developing unit housing a second developer different in the color thereof from the color of the first developer housed in the first developing unit, and supplies said electrostatic latent image holding member with the developer housed either in the first developing unit or in the second developing unit so as to develop the electrostatic latent image formed on said electrostatic latent image holding member;

a supply means, disposed at a predetermined place of the housing of the copying apparatus, for supplying a material to be copied sequentially to said electrostatic latent image holding member;

a transfer means, disposed in the periphery of said electrostatic latent image holding member in the housing of the copying apparatus, for transferring the developed image to the material to be copied supplied by said supply means;

a switching means for switching a copy mode from a first mode in which a monochrome copying operation is carried out by selecting any one of the developing units to a second mode in which a plural color copying operation is carried out during one image exposure operation and vice versa;

a developing unit selection means for selecting and specifying any one of the developing units when the first mode is specified by said switching means;

a first mode copying operation means for carrying out a monochrome copying operation when the first mode is specified by said switching means;

a region specifying means for specifying a region of the original document image to be developed by the first developer so as to be copied and a region of the original document image to be developed by the second developer so as to be copied;

a drive means for developing an electrostatic latent image corresponding to a region specified by said region specifying means by the first developing unit housing the first developer during one image exposure operation and for developing an electrostatic latent image corresponding to a region specified by said region specifying means by the second developing unit housing the second developer;

a second mode copying operation means for operating said drive means to carry out a copying operation in the second mode when the second mode is specified by said switching means;

a storing means for storing a developing unit which has been selected in the first mode when a copy mode is switched by said switching means from the first mode to the second mode;

a return control means for automatically selecting a developing unit which has been stored by said storing means when a copy mode is switched from the second mode to the first mode by said switching means.

4. A copying apparatus as claimed in claim 3, wherein said developing unit selection means selects a developing unit by specifying the color of a developer housed in each of the developing units.

5. A copying apparatus comprising:

an original document placing plate which is disposed at a predetermined place of the housing of the copying apparatus and on which an original document is placed;

an electrostatic latent image holding member rotatably supported in the housing of the copying apparatus;

means for forming an electrostatic latent image, disposed in the vicinity of said original document placing plate, for exposing an image of the original document placed on said original document placing plate so as to form an electrostatic latent image, corresponding to the image of the original document, on said electrostatic latent image holding member;

a developing means which is disposed in the periphery of said electrostatic latent image holding member in the housing of the copying apparatus, and has at least a first developing unit having a developing sleeve housing a first developer and a second developing unit having a developing sleeve housing a second developer different in its color from the color of the first developer housed in the first developing unit, and supplies said electrostatic latent image holding member with the developer housed either in the first developing unit or in the second developing unit so as to develop the electrostatic latent image formed on said electrostatic latent image holding member;

a first drive means and a second drive means for driving the first developing sleeve and the second developing sleeve, respectively;

a supply means, disposed at a predetermined place of the housing of the copying apparatus, for sequentially supplying said electrostatic latent image holding member with a material to be copied;

a transfer means, disposed in the periphery of said electrostatic latent image holding member in the housing of the copying apparatus, for transferring the developed image to the material to be copied supplied by said supply means;

a switching means for switching a copy mode from a first mode in which a monochrome copying operation is carried out by selecting any one of the developing units to a second mode in which a plural color copying operation is carried out during one image exposure operation and vice versa;

a developing unit selection means for selecting any one of the developing units when the first mode is specified by said switching means and allowing said first drive means to drive the first developing sleeve or said second drive means to drive the second developing sleeve;

a first mode copying operation means for carrying out a monochrome copying operation when the first mode is specified by said switching means;

a region specifying means for specifying a region of the original document image to be developed by the first developer so as to be copied and a region of the original document image to be developed by the second developer so as to be copied;

a drive control means for developing an electrostatic latent image into a visible image with the first developer by allowing said first drive means to drive the first developing sleeve without driving the second developing sleeve when an electrostatic latent image corresponding to a region specified by said region specifying means is developed by the first developing unit during one image exposure operation, and for developing an electrostatic latent image into a visible image with the second developer by allowing said second drive means to drive the second developing sleeve without driving the first developing sleeve when an electrostatic latent image corresponding to a region specified by said region specifying means is developed by the second developing unit during one image exposure operation;

a second mode copying operation means for operating said drive control means so as to carry out a copying operation in the second mode when the second mode is specified by said switching means;

a storing means for storing a developing unit which has been selected in the first mode when a copy mode is switched by said switching means from the first mode to the second mode;

a return control means for automatically selecting a developing unit which has been stored by said storing means when a copy mode is switched by said switching means from the second mode to the first mode.

6. A copying apparatus as claimed in claim 5, wherein the first developing sleeve is provided with a first magnetic means having a plurality of N poles and S poles disposed in the circumferential direction thereof, and the second developing sleeve is provided with a second magnetic means having a plurality of N poles and S poles disposed in the circumferential direction thereof; a first moving means and a second moving means are provided in the housing of the copying machine so as to rotate the first magnetic means and the second magnetic means at a predetermined angle, respectively.

7. A copying machine as claimed in claim 6, wherein when an electrostatic latent image corresponding to a region specified by said specifying means is developed by the first developer, said first moving means rotates said first magnetic means so as to allow any one of a plurality of the N poles and S poles-to be at a position which confronts the developing region of said electrostatic latent image holding member and said second moving means rotates said second magnetic means so as not to allow any one of the N poles and the S poles to be positioned within the developing region of said electrostatic latent image holding member, whereby the developing operation of the second developer is prevented.

8. A copying machine as claimed in claim 6, wherein when an electrostatic latent image corresponding to a region specified by said specifying means is developed by the second developer, said second moving means rotates said second magnetic means so as to allow any one of a plurality of the N poles and S poles to be at a position which confronts the developing region of said electrostatic latent image holding member and said first moving means rotates said first magnetic means so as to avoid any one of the N poles and the S poles being positioned within the developing region of said electrostatic latent image holding member, whereby the developing operation of the first developer is prevented.

9. A copying machine comprising:

an original document placing plate which is disposed at a predetermined place of a housing of the copying apparatus and on which an original document is placed;

an electrostatic latent image holding member rotatably supported in the housing of the copying apparatus;

means for forming an electrostatic latent image, disposed in the vicinity of said original document placing plate, for exposing an image of the original document placed on said original document placing plate so as to form an electrostatic latent image, corresponding to the image of the original document, on said electrostatic latent image holding member;

a developing means which is disposed in the periphery of said electrostatic latent image holding member in the housing of the copying apparatus, and has at least a first developing unit which houses a first developer and has a first developing sleeve provided with a plurality of N poles and S poles disposed in the circumferential direction thereof and a second developing unit which houses a second developer different in its color from the first developer and has a second developing sleeve provided with a plurality of N poles and S poles disposed in the circumferential direction thereof and supplies said electrostatic latent image holding member with a developer housed either in the first developing unit or in the second developing unit so as to develop the electrostatic latent image formed on said electrostatic latent image holding member;

a first drive means and a second drive means for rotating the first developing sleeve and the second developing sleeve at a predetermined angle, respectively;

a supply means, disposed at a predetermined place of the housing of the copying apparatus, for sequentially supplying said electrostatic latent image holding member with a material to be copied;

a transfer means, disposed in the periphery of said electrostatic latent image holding member in the housing of the copying apparatus, for transferring the developed image to the material to be copied supplied by said supply means;

a switching means for switching a copy mode from a first mode in which a monochrome copying operation is carried out by selecting any one of the developing units to a second mode in which a plural color copying operation is carried out during one image exposure operation and vice versa;

a developing unit selection means for selecting any one of the developing units when the first mode is specified by said switching means, whereby the first developing sleeve is driven by the said first drive means or the second developing sleeve is driven by said second drive means;

a first mode copying operation means for carrying out a monochrome copying operation when the first mode is specified by said switching means;

a region specifying means for specifying a region of the original document image to be developed by the first developer so as to be copied and a region of the original document image to be developed by the second developer so as to be copied;

a drive control means for, when an electrostatic latent image corresponding to a region specified by said region specifying means is developed by the first developing unit housing the first developer, developing an electrostatic latent image into a visible image with the first developer by allowing said first drive means to drive the first developing sleeve during one image exposure operation and for rotating said second magnetic means so as not to allow any one of the N poles and the S poles to be present in the specified developing region in order to prevent the developing operation of the second developer add for, when an electrostatic latent image corresponding to a region specified by said region specifying means is developed by the second developing unit housing the second developer, developing an electrostatic latent image into a visible image with the second developer by allowing said second drive means to drive the second developing sleeve during one image exposure operation and for rotating said first magnetic means so as not to allow any one of the N poles and the S poles to be present in the specified developing region in order to prevent the developing operation of the first developer;

a second mode copying operation means for operation said drive control means so as to carry out a copying operation in the second mode when the second mode is specified by said switching means;

a storing means for storing a developing unit which has been selected in the first mode when a copy mode is switched by said switching means from the first mode to the second mode;

a return control means for automatically selecting a developing unit which has been stored by said storing means when a copy mode is switched by said switching means from the second mode to the first mode.

10. A copying apparatus comprising;

means for forming an image which has a first developing unit housing a first developer and a second developing unit housing a second developer different in color thereof from a color of the first developer housed in the first developing unit;

a mode selection means for selecting one of a first mode in which a monochromatic image forming operation is carried out by selecting any one of the developing units and a second mode in which a multicolor image forming operation is carried out by selecting both of the developing units;

a developing unit selection means for selecting any one of the developing units when the first mode is selected;

a first display means for displaying a kind of the developing unit selected in the first mode; and a second display means for displaying both kinds of the developing units when the second mode is selected.

11. A copying apparatus as claimed in claim 10, wherein at least one of the developing units is removably and is replaceable by any one of the remaining developing unit having a different color of a developer.

12. A copying apparatus as claimed in claim 11, further comprising a detecting means for detecting a kind of the developing unit attached to said means for forming an image.

13. A copying apparatus as claimed in claim 10, further comprising;

a storing means for storing a kind of the developing unit selected by said developing unit selection means when the first mode is selected; and a third display means for displaying a kind of the developing unit which stored by said storing means corresponding to cancellation of the second mode.

14. A copying apparatus as claimed in claim 10, wherein said means for forming an image drives the first developing unit and the second developing unit in order to form a multicolor image when the second mode is selected.

15. A copying apparatus as claimed in claim 14, wherein said second display means displays both kinds of the developing units corresponding to selection of the second mode when said means for forming an image is stopped to be driven and displays any one of the developing unit driving when said means for forming an image is driven.

16. A copying apparatus as claimed in claim 14, wherein said means for forming an image drives the first developing unit and the second developing unit in order to form a multicolor image when one forming image operation is carried out in the second mode.

17. A copying apparatus comprising;

means for forming an image which has a plurality of developing units, each of the developing units housing a developer different in color thereof from colors of developers of the remaining developing units;

a color display means for displaying at least one of the colors of the developers of the developing units;

a color specifying means for specifying at least one of the colors of the developers of the developing units;

a mode selection means for selecting one of a first mode in which a monochromatic image forming operation is carried out by selecting any one of the developing units and a second mode in which a multicolor image forming operation is carried out;

a first display control means for controlling said color display means so as to display the color of the developer of the developing unit specified by said color specifying means when the first mode is selected; and a second display control means for controlling said color display means so as to display the colors of the developers housed in all of the developing units when the second mode is selected.

18. A copying apparatus comprising;

means for forming an image having two developing units, each of the developing unit housing a developer different in color thereof from colors of the remaining developing units and at least any one of the developing units being removably;

a detecting means for detecting kinds of the developing units attached to said means for forming an image;

a color display means having display elements respectively indicating the kinds of the colors of the developers which said detecting means is detectable;

a mode selection means for selecting one of a first mode in which an image forming operation is carried out by selecting any one of the developing units attached to said means for forming an image and a second mode in which an image forming operation is carried out by selecting both of the developing units attached to said means for forming an image;

a first display control means for driving the display element corresponding to any one of the developing units attached to said means for forming an image when the first mode is selected; and a second display control means for driving both of the display elements respectively corresponding to the developing units attached to said means for forming an image when the second mode is selected.

19. A copying apparatus as claimed in claim 18, further comprising;

a developing unit selection means for selecting the developing unit to be used when the first mode is selected;

a storing means for storing a kind of the developing unit selected by said developing unit selection means; and a third display control means for driving the display element indicating a kind which has been stored by said storing means by means of switching a mode from the second mode to the first mode.

20. A copying apparatus as claimed in claim 18, wherein said means for forming an image drives the first developing unit and the second developing unit in order to form a multicolor image when the second mode is selected.

21. A copying apparatus as claimed in claim 20, wherein said second display control means drives the display elements indicating both kinds of the developing units according to selecting the second mode when said means for forming an image is stopped to be driven and drives at least one of the display elements indicating kinds of the developing units to be driving when said means for forming an image is driven.

22. A copying apparatus comprising;

a photosensitive member;

means for forming an electrostatic latent image on the surface of said photosensitive member;

a first developing unit having a first developer to develop the electrostatic latent image;

a second developing unit having a second developer different in color thereof from a color of the first developer housed in said first developing unit which develops the electrostatic latent image;

a drive means for respectively driving said first developing unit and said second developing unit in order so as to form a multicolor image;

a color display means for displaying the color of the developer housed in said first developing unit and the color of the developer housed in said second developing unit; and a display control means for controlling said color display means so as to display the color of the developer housed in at least one of said developing unit which is driven.

23. A copying apparatus as claimed in claim 22, wherein said color display means has a first display element for displaying the color of the first developer housed in said first developing unit and a second display element for displaying the color of the second developer housed in said second developing unit.

24. A copying apparatus as claimed in claim 23, wherein said display control means controls to turn on the first display element and to turn off the second display element when said first developing unit is driven, and controls to turn on the second display element and to turn off the first display element when said second developing unit is driven.

25. A copying apparatus as claimed in claim 24, wherein said display control means controls to turn on both of the first display element and the second display element when both of said first developing unit and said second developing unit are stopped to be driven.

26. A copying apparatus as claimed in claim 23, wherein said display control means controls to turn on both of the first display element and the second display element when both of said first developing unit and said second developing unit are stopped to be driven, controls to flash the first display element and to turn on the second display element when said first developing unit is driven, and controls to turn on the first display element and to flash the second display element when said second developing unit is driven.

27. A copying apparatus comprising;

a photosensitive member;

means for forming an electrostatic latent image on the surface of said photosensitive member;

a plurality of developing unit having a developer to develop the electrostatic latent image, each of the developer housed in each developing unit having a different in color thereof from colors of the developers housed in the remaining developing unit;

a drive means for respectively driving said developing unit in order so as to form a multicolor image;

a color display means for displaying the color of the developer housed in each developing unit; and a display control means for controlling said display means so as to display the color of the developer housed in at least one of said developing unit which is driven.

28. A copying apparatus comprising;

means for forming an image which has a plurality of developing units, each of the developing units housing a developer different in color thereof from colors of the developers of the remaining developing units;

a color display means for displaying the colors of the developer of the developing units;

as mode selection means for selecting one of a first mode in which a monochromatic image forming operation is carried out by selecting any one of the developing units and a second mode in which a multicolor image forming operation is carried out;

a developing unit selection means for selecting any one of the developing units when the first mode is selected by said mode, selection means;

a first display control means for controlling said color display means so as to display the color of the developer of the developing unit selected by said developing unit selection means when the first mode is selected by said mode selection means;

a storing means for storing the color of the developer of the developing unit selected by said developing unit selection means when the first mode is selected by said mode selection means;

a second display control means for controlling said color display means so as to display the color of the developer of the developing unit selected by said developing unit selection means when the second mode is selected, the color being different from the color of the developer of the developing unit when the first mode has been selected; and a third display control means for controlling said display means so as to display the color of the developer of the developing unit means stored by said storing means according to cancellation of the second mode.

29. A copying apparatus as claimed in claim 28, wherein said second display control means displays all color of the developers of the developing units when the second mode is selected.

30. A copying apparatus as claimed in claim 28, wherein said second display control means displays at least one color of the developer of the developing unit which is driven to form an image in the second mode.

* * * * *

UNITED STATES PATENT AND TRADEMARK OFFICE

CERTIFICATE OF CORRECTION

PATENT NO. : 4,862,216

DATED : August 29, 1989

INVENTOR(S) : Toshikazu HIGASHI, et al.

It is certified that error appears in the above-identified patent and that said Letters Patent is hereby corrected as shown below:

In Column 29, line 29 (in claim 28, line 9):

Change "as mode" to --a mode--

Signed and Sealed this

Twenty-sixth Day of March, 1991

*Attest:*

HARRY F. MANBECK, JR.

*Attesting Officer*

*Commissioner of Patents and Trademarks*